US008331808B2

(12) United States Patent
Kaneda

(10) Patent No.: US 8,331,808 B2
(45) Date of Patent: Dec. 11, 2012

(54) CONTROL APPARATUS, CONTROL METHOD, AND STORAGE MEDIUM FOR RESUMING PRINTING AFTER BEING INTERRUPTED

(75) Inventor: Takeshi Kaneda, Yokohama (JP)

(73) Assignee: Canon Kabushiki Kaisha (JP)

( * ) Notice: Subject to any disclaimer, the term of this patent is extended or adjusted under 35 U.S.C. 154(b) by 753 days.

(21) Appl. No.: 12/421,683

(22) Filed: Apr. 10, 2009

(65) Prior Publication Data

US 2009/0257760 A1 Oct. 15, 2009

(30) Foreign Application Priority Data

Apr. 11, 2008 (JP) ..... 2008-103785

(51) Int. Cl.
*G03G 15/00* (2006.01)

(52) U.S. Cl. ..... 399/19; 399/18

(58) Field of Classification Search ..... 399/18, 399/19

See application file for complete search history.

(56) References Cited

U.S. PATENT DOCUMENTS

| | | | | |
|---|---|---|---|---|
| 5,790,766 | A * | 8/1998 | Sakamoto et al. | 358/1.14 |
| 5,839,014 | A * | 11/1998 | Takahashi et al. | 399/21 |
| 6,075,925 | A * | 6/2000 | Downing et al. | 358/1.1 |
| 6,449,440 | B1 | 9/2002 | Sawada | |
| 7,395,021 | B2 | 7/2008 | Tamura et al. | |
| 2006/0127143 | A1 | 6/2006 | Tamura et al. | |
| 2006/0133870 | A1 | 6/2006 | Ng et al. | |
| 2007/0291286 | A1 * | 12/2007 | Utsunomiya et al. | 358/1.8 |
| 2007/0292176 | A1 | 12/2007 | Tamura et al. | |
| 2008/0055626 | A1 | 3/2008 | Root et al. | |

FOREIGN PATENT DOCUMENTS

| | | | |
|---|---|---|---|
| JP | 2001-022235 A | | 1/2001 |
| JP | 2005-153218 A | | 6/2005 |
| JP | 2007-155963 A | | 6/2007 |
| JP | 2007163755 | * | 6/2007 |
| JP | 2008-059020 A | | 3/2008 |
| WO | 2008/027183 A2 | | 3/2008 |

OTHER PUBLICATIONS

Extended European Search Report issued in corresponding European Patent Application No. 09156872.5 dated Jul. 23, 2009.
Korean Office Action to corresponding KR 10-2009-31542, Notification for Submission of Argument, dated Sep. 26, 2011. English translation provided.
JP Office Action issued Oct. 9, 2012 for corresponding JP 2008-103785.

* cited by examiner

*Primary Examiner* — Judy Nguyen
*Assistant Examiner* — Blake A Tankersley
(74) *Attorney, Agent, or Firm* — Rossi, Kimms & McDowell LLP

(57) ABSTRACT

A control apparatus which makes it possible to realize a configuration for processing a plurality of print jobs efficiently without waste while meeting needs for performing a glossing process on prints. When a sheet printed in a first process is fed from a sheet feeder, the printing apparatus executes a second printing process for processing the fed sheet. When an interrupting factor occurs during execution of the second printing process to cause interruption of the processing, the interrupted processing is resumed on condition that the interrupting factor is removed. A resuming method of resuming the processing is determined based on contents of the processing in the second process.

7 Claims, 15 Drawing Sheets

FIG.7A

| JAM IN 2ND PRINTING PROCESS | CANCEL JOB | STOP JOB TEMOPRARILY<br>REQUEST USER TO DETERMINE WHETHER TO CONTINUE JOB TO EXECUTE 2ND PRINTING PROCESS ON REMAINING COPIES/PAGES ON SHEET FEEDER<br>DO NOT CONTINUE ⇒ CANCEL JOB<br>CONTINUE ⇒ AUTOMATICALLY DETERMINE RESUMING POSITION :<br>PAGE NEXT TO JAMMED PAGE (1ST PAGE OF NEXT COPY) ⇒<br>RESTART AFTER COMPLETION OF REMOVAL OF JAMMED SHEET | STOP JOB TEMOPRARILY<br>REQUEST USER TO DETERMINE WHETHER TO CONTINUE JOB TO PERFORM 2ND PRINTING PROCESSING ON REMAINING PAGES ON SHEET FEEDER)<br>DO NOT CONTINUE ⇒ CANCEL JOB<br>CONTINUE ⇒ RESTART POSITION ?<br>PAGE NEXT TO JAMMED PAGE ⇒ RESTART AFTER REMOVAL OF JAMMED SHEET | |
|---|---|---|---|---|
| JAM IN 1ST PRINTING PROCESS | AFTER REMOVING JAMMED SHEET, AUTOMATICALLY RESUME FROM PAGE WHERE JAM OCCURRED | | | |
| NUMBER OF COPIES | 1 | m | 1 | |
| NUMBER OF CLEAR PAGES | 1 | 1 | 1 | |
| NUMBER OF DOCUMENT PAGES | 1 | 1 | n | |
| CATEGORY | 1 | II | III | |

FIG.7B

| | | | | | |
|---|---|---|---|---|---|
| IV | n | 1 | m | | STOP JOB TEMOPRARILY<br>REQUEST USER TO DETERMINE WHETHER TO CONTINUE JOB TO PERFORM 2ND PRINTING PROCESS ON REMAINING COPIES/PAGES ON SHEET FEEDER<br>DO NOT CONTINUE ⇒ CANCEL JOB<br>CONTINUE ⇒ RESTART POSITION?<br>PAGE NEXT TO JAMMED PAGE ⇒ RESTART AFTER REMOVAL OF JAMMED SHEET<br>COPY NEXT TO JAMMED COPY ⇒ RESTART PRINTING, AFTER REMOVING OF REMAINING PART OF COPY BEING PROCESSED, AND SETTING A BUNDLE OF PREPRINT SHEETS FOR EACH COPY ON SHEET FEEDER |
| V | n | n | 1 | | STOP JOB TEMOPRARILY<br>REQUEST USER TO DETERMINE WHETHER TO CONTINUE JOB TO PERFORM 2ND PRINTING PROCESSING ON REMAINING PAGES ON SHEET FEEDER<br>DO NOT CONTINUE ⇒ CANCEL JOB<br>CONTINUE ⇒ RESTART POSITION ?<br>PAGE NEXT TO JAMMED PAGE ⇒ RESTART AFTER REMOVAL OF JAMMED SHEET |
| VI | n | n | m | | STOP JOB TEMOPRARILY<br>REQUEST USER TO DETERMINE WHETHER TO CONTINUE JOB TO PERFORM 2ND PRINTING PROCESS ON REMAINING COPIES/PAGES ON SHEET FEEDER<br>DO NOT CONTINUE ⇒ CANCEL JOB<br>CONTINUE ⇒ RESTART POSITION?<br>PAGE NEXT TO JAMMED PAGE ⇒ RESTART AFTER REMOVAL OF JAMMED SHEET<br>COPY NEXT TO JAMMED COPY ⇒ RESTART PRINTING, AFTER REMOVING OF REMAINING PART OF COPY BEING PROCESSED, AND SETTING A BUNDLE OF PREPRINT SHEETS FOR EACH COPY ON SHEET FEEDER |

CONTROL APPARATUS, CONTROL METHOD, AND STORAGE MEDIUM FOR RESUMING PRINTING AFTER BEING INTERRUPTED

BACKGROUND OF THE INVENTION

1. Field of the Invention

The present invention relates to a control apparatus which is applied to performing a glossing process, a control method for the control apparatus, and a computer-readable storage medium storing a computer-executable program for implementing the control method.

2. Description of the Related Art

In recent years, a printing apparatus configured to be capable of performing a glossing process for providing gloss to prints has been under development (see US Patent Application Publications No. 2006/0127143 and No. 2007/0292176).

Proposals of image processing enabling a printing apparatus to achieve the above-mentioned glossing process for providing gloss to prints are being discussed. However, there is still much left to be studied before the printing apparatus capable of achieving the glossing process is actually placed on the market as a commercially available product.

For example, such a printing apparatus is not only required to realize the above-mentioned glossing process, but it also matters whether the printing apparatus is capable of efficiently processing various print jobs without waste. Particularly in the POD (print-on-demand) market or the like where importance is attached to high quality and added values, it can be expected that the glossing process is demanded. However, in such a market, higher productivity and lower costs can also be regarded as important.

SUMMARY OF THE INVENTION

The present invention provides a control apparatus which makes it possible to realize a configuration for processing a plurality of print jobs efficiently without waste while meeting needs for performing a glossing process on prints.

In a first aspect of the present invention, there is provided a control apparatus comprising a printing control unit configured to feed a sheet printed in a first process from a sheet feed unit and cause a printing unit to execute a second process for processing the fed sheet, a resuming unit configured to be operable when processing executed by the printing control unit in the second process is interrupted by an interrupting factor, to resume the interrupted processing on condition that the interrupting factor is removed, and a control unit configured to determine a resuming method of resuming the processing by the resuming unit, based on contents of the processing in the second process.

In a second aspect of the present invention, there is provided a control apparatus comprising a printing control unit configured to cause a printing unit to execute a first process for feeding a sheet from a sheet feed unit and processing the fed sheet, and a second process for feeding the sheet printed in the first process from the sheet feed unit and processing the fed sheet, a resuming unit configured to be operable when the processing caused to be executed by the printing control unit is interrupted by an interrupting factor, to resume the interrupted processing on condition that the interrupting factor is removed, and a control unit configured to cause a method of resumption by the resuming unit to be made different between a case where the interrupting factor occurs in the first process and a case where the interrupting factor occurs in the second process.

In a third aspect of the present invention, there is provided a control method for a control apparatus, comprising feeding a sheet printed in a first process from a sheet feed unit and causing a printing unit to execute a second process for processing the fed sheet, resuming, when processing executed in the second process is interrupted by an interrupting factor, the interrupted processing on condition that the interrupting factor is removed, and determining a resuming method of resuming the interrupted processing, based on contents of the processing in the second process.

In a fourth aspect of the present invention, there is provided a control method for a control apparatus, comprising causing a printing unit to execute a first process for feeding a sheet from a sheet feed unit and processing the fed sheet, and a second process for feeding the sheet printed in the first process from the sheet feed unit and processing the fed sheet, resuming, when the processing which the printing unit is caused to execute is interrupted by an interrupting factor, the interrupted processing on condition that the interrupting factor is removed, and causing a method of resumption to be made different between a case where the interrupting factor occurs in the first process and a case where the interrupting factor occurs in the second process.

In a fifth aspect of the present invention, there is provided a storage medium readable by a computer and storing a computer-executable program for controlling a control apparatus, the computer-executable program comprising a code to feed a sheet printed in a first process from a sheet feed unit and cause a printing unit to execute a second process for processing the fed sheet, a code to resume, when processing executed in the second process is interrupted by an interrupting factor, the interrupted processing on condition that the interrupting factor is removed, and a code to determine a resuming method of resuming the interrupted processing, based on contents of the processing in the second process.

In a sixth aspect of the present invention, there is provided a storage medium readable by a computer and storing a computer-executable program for controlling a control apparatus, the computer-executable program comprising a code to cause a printing unit to execute a first process for feeding a sheet from a sheet feed unit and processing the fed sheet, and a second process for feeding the sheet printed in the first process from the sheet feed unit and processing the fed sheet, a code to resume, when the processing which the printing unit is caused to execute is interrupted by an interrupting factor, the interrupted processing on condition that the interrupting factor is removed, and a code to cause a method of resumption to be made different between a case where the interrupting factor occurs in the first process and a case where the interrupting factor occurs in the second process.

According to the present invention, it is possible to realize a configuration for processing a plurality of print jobs efficiently without waste while meeting needs for performing a glossing process on prints.

The features and advantages of the invention will become more apparent from the following detailed description taken in conjunction with the accompanying drawings.

BRIEF DESCRIPTION OF THE DRAWINGS

FIGS. 7A and 7B are table diagrams showing categories of the job recovery/cancellation control process executed by the printing apparatus including the control apparatus according to the embodiment.

DETAILED DESCRIPTION OF THE EMBODIMENTS

The present invention will now be described in detail below with reference to the accompanying drawings showing an embodiment thereof.

Figure 1:
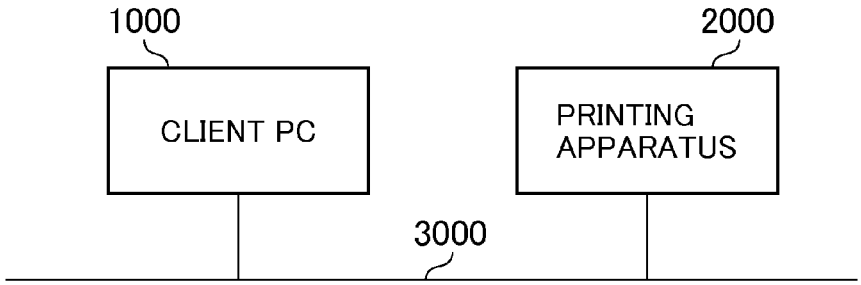
FIG. 1 is a block diagram of a printing system including a printing apparatus including a control apparatus according to an embodiment of the present invention.

FIG. 1 is a block diagram of a printing system including a printing apparatus according including a control apparatus to an embodiment of the present invention.

The printing system is comprised of a client PC 1000, and the printing apparatus 2000 each connected to a network 3000, such as a LAN. The client PC 1000 generates PDL (Page Description Language) print data as a print job and sends the print job to the printing apparatus 2000. The printing apparatus 2000 carries out a printing process based on the print job sent from the client PC 1000.

Further, the printing apparatus 2000 is configured to be capable of performing a glossing process on a preprint sheet as a print medium subjected to printing process by a printer engine 103 (printing unit), using the printer engine 103. The glossing process is executed to change the glossiness of an image on the preprint sheet having the image printed thereon (equivalent in meaning to a print) by the printer engine 103. In short, the glossing process is equivalent in meaning to processing for changing the glossiness of the print.

In the present embodiment, the print job input to the printing apparatus 2000 from the client PC 1000 is assumed to be a gloss print job for sequentially executing a first printing process for carrying out the printing process and a second printing process for carrying out the glossing process, or a non-gloss print job which does not require the second printing process.

The present embodiment is applied to the printing apparatus 2000/the printing system configured to be capable of increasing the glossiness of an image printed on a print medium compared with glossiness before execution of glossing process, i.e. making the image glossier than before execution of the glossing process. Further, the present embodiment is applied to the printing apparatus 2000/the printing system configured to be capable of reducing the glossiness of an image printed on a print medium compared with glossiness before execution of the glossing process, i.e. making the image feeling more matte than before execution of the glossing process. Thus, the present embodiment can be applied not only to a case where glossiness is increased but also to a case where glossiness is reduced, and the application thereof is by no means limited to one of them. Insofar as the printing apparatus 2000 (including the printer engine 103) is so configured as to be capable of performing the glossing process on a print medium (print sheet) having an image printed thereon, the present embodiment is applicable to any configuration thereof. Although in the present embodiment, the printing apparatus is configured to be capable of complying with both of the case where the glossiness of a print medium is increased and the case where the glossiness is reduced (i.e. a matte feel is added) as mentioned above, the printing apparatus may be configured to have only one of the function of making a print glossy and the function of making a print matte.

Figure 2:
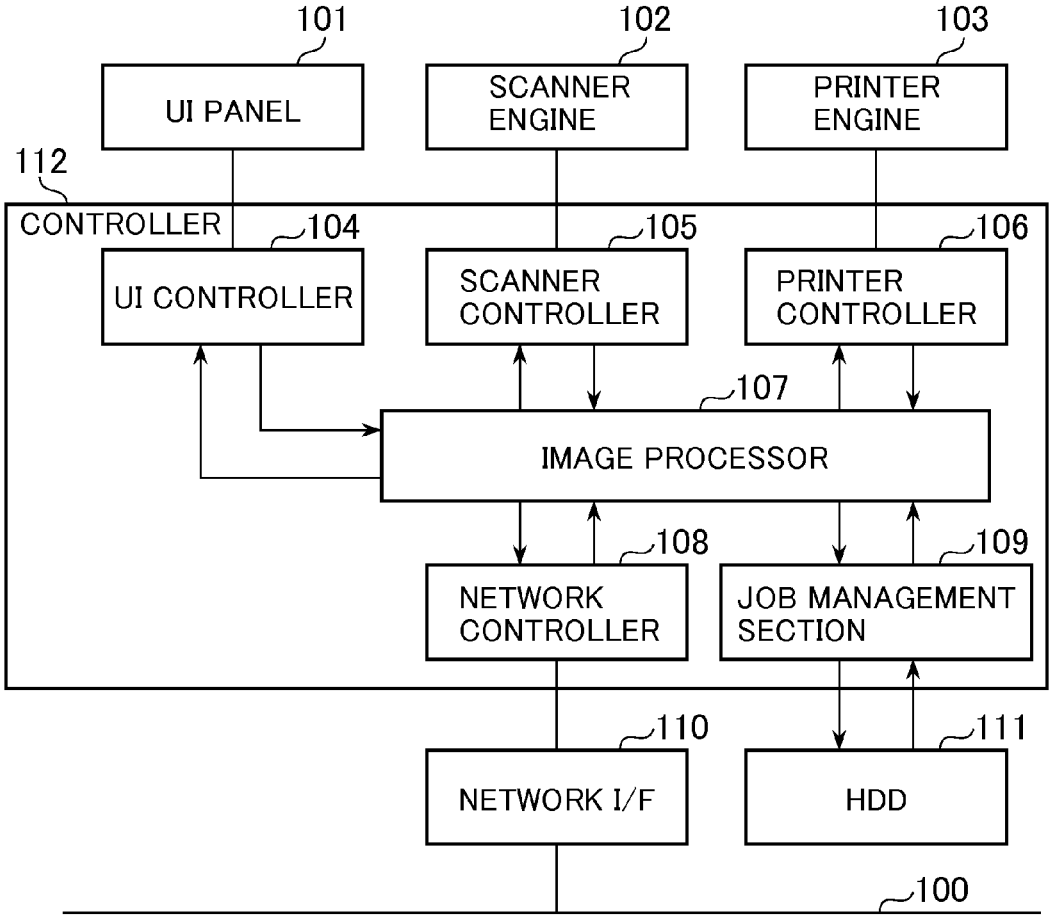
FIG. 2 is a functional block diagram of the printing apparatus appearing in FIG. 1.

FIG. 2 is a functional block diagram of the printing apparatus 2000 appearing in FIG. 1.

The printing apparatus 2000 is comprised of a UI panel 101, a scanner engine 102, a network interface 110, an HDD device 111, the printer engine 103, and a controller 112.

The UI panel 101 displays various operation screens and the like to thereby provide user interface. The scanner engine 102 performs scanning for reading original images, and the printer engine 103 performs printing based on PDL print data transferred from the client. PC 1000.

The controller 112 is comprised of a UI controller 104, a scanner controller 105, a printer controller 106, an image processor 107, a network controller 108, and a job management section 109. The UI controller 104 controls the display of the UI panel 101, and the scanner controller 105 controls the start and stoppage of a scanning operation of the scanner engine 102. The printer controller 106 transfers image data received from the image processor 107 to the printer engine 103, and at the same time selectively causes various accessories to perform finishing processing, such as stapling, punching, or sorting, on prints. The network controller 108 causes the network interface 110 to receive PDL print data via the network 3000 and transfers the received PDL print data to the image processor 107.

When the network controller 108 receives the PDL print data from an external apparatus, the job management section 109 immediately starts managing various statuses of an associated print job. Further, the job management section 109 requests each of the controllers to perform necessary processing on the received PDL print data. The job management section 109 also performs determination of a resuming position in the case of occurrence of a sheet jam and a conditional determination of cancellation of a print job, based on status information from the above-mentioned sections within the controller 112.

The image processor 107 receives PDL print data for each of the first and second printing processes from the network controller 108. Then, the image processor 107 performs RIP (Raster Image Processing) and the like processing on the PDL print data, and achieves the printing process by the printer engine 103 via the printer controller 106.

Figure 3:
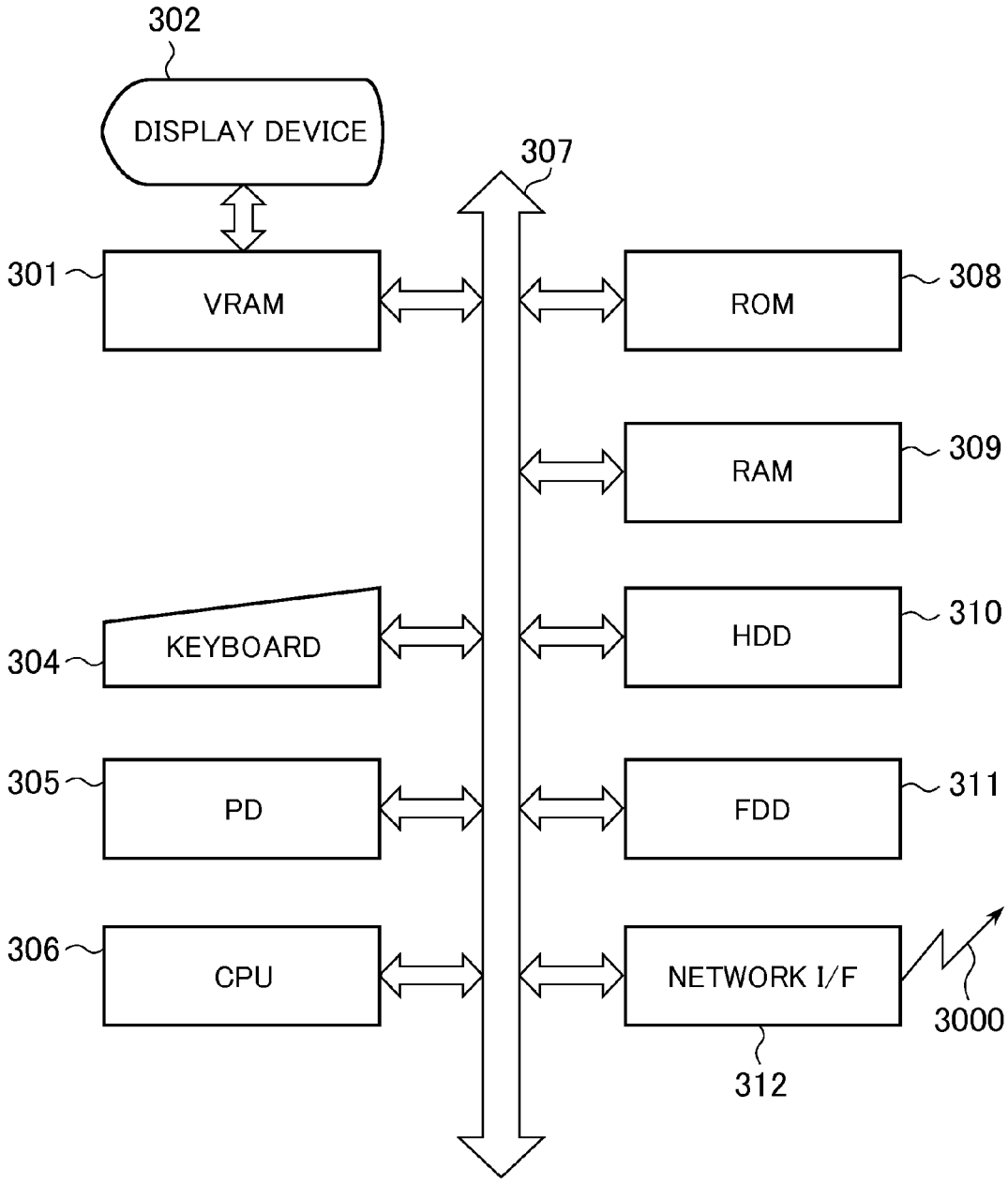
FIG. 3 is a block diagram showing the hardware configuration of a client PC.

FIG. 3 is a block diagram showing the hardware configuration of the client PC 1000.

The client PC 1000 includes a video RAM (VRAM) 301, a keyboard 304, a pointing device (PD) 305, a CPU 306, a ROM 308, and a RAM 309. The client PC 1000 further includes a hard disk (HDD) 310, a floppy (registered trademark) disk (FDD) 311, and a network interface 312. These devices are interconnected by a bus 307.

The CPU 306 executes programs stored in the ROM 308 and the hard disk 310. The RAM 309 is used not only as a work area for arithmetic operations and the like executed by the CPU 306, but also as a temporary save area for carrying out error handling. The hard disk 310 and the floppy (registered trademark) disk 311 are used to store various databases and application programs, etc. The video RAM 301 is a memory for loading and storing characters and images to be displayed on the screen of a display device 302. The keyboard 304 is provided with various kinds of entry keys. The pointing device 305 is implemented e.g. by a mouse for pointing to an icon and the like on the screen. The network interface 312 is connected to the network 3000.

Figure 4:
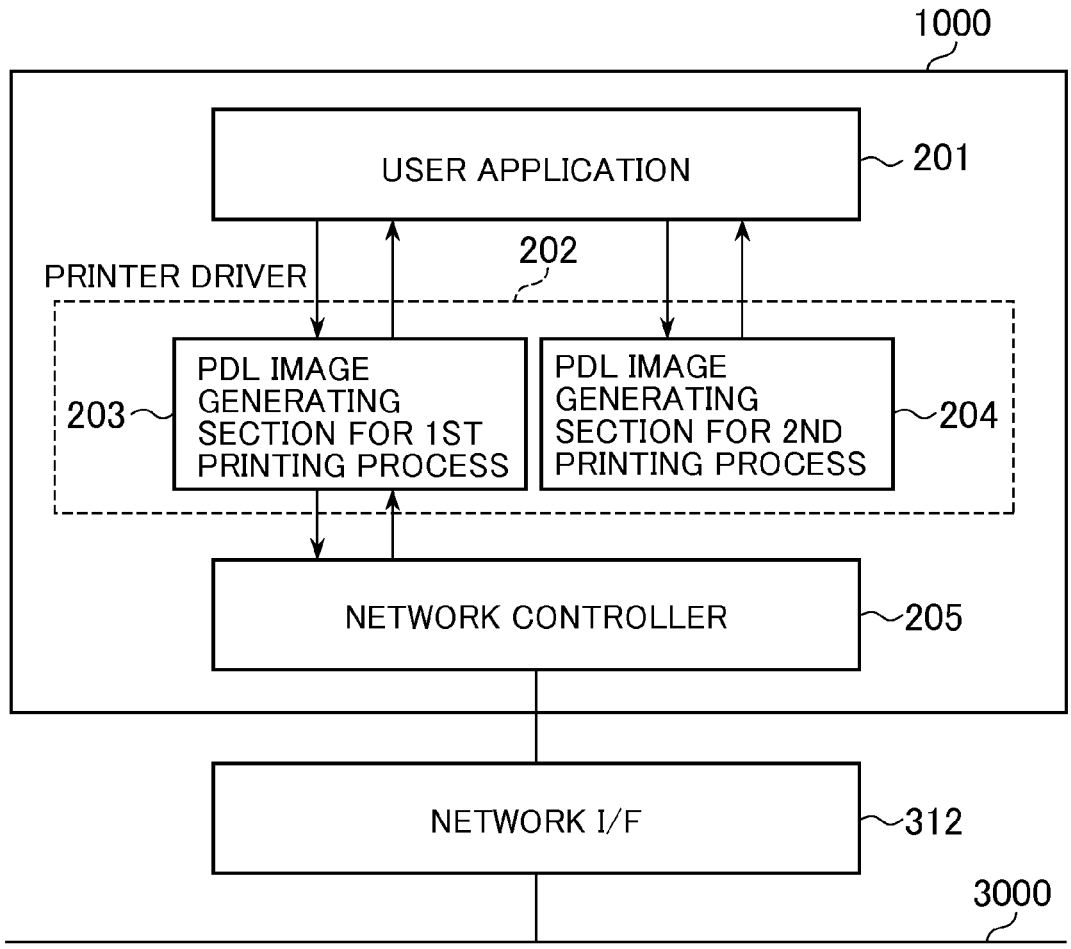
FIG. 4 is a block diagram showing the software configuration of the client PC.

FIG. 4 is a block diagram showing the software configuration of the client PC 1000.

A user uses a user application 201 on the client PC 1000 to generate a PDL print data item for the first printing process and a PDL print data item for the second printing process. Combinations of the PDL print data items generated at this time will be described hereinafter with reference to table diagrams shown in FIGS. 7A and 7B. Further, the first and second printing processes will also be described hereinafter.

In the case of printing data generated using the application 201, the user causes a printer driver 202 to convert the application data into PDL print data and transfers the PDL print data to the printing apparatus 2000 via a network controller 205. At this time, the PDL print data is divided into a PDL print data item specific to the first printing process and a PDL print data item specific to the second printing process, and the divided PDL print data items are transferred from the client PC 1000 to the printing apparatus 2000.

The PDL print data item for printout by the first printing process is generated by a PDL image generating section 203 for the first printing process. The PDL print data item contains data of general four colors (C (cyan), M (magenta), Y (yellow), and K (black)). The PDL print data item generated by a PDL image generating section 204 for the second printing process is assumed to be clear toner data, barcode data, or various kinds of background pattern data.

It is possible to form the PDL print data item used in the second printing process such that the same image is printed on all pages output in the first printing process or such that different images are printed on the respective pages. In the former case, the PDL print data item for the second printing process is configured to have a single page, while in the latter case, the number of PDL pages for the second printing process is equal to that for the first printing process.

The printing apparatus 2000 according to the present embodiment is configured to be capable of performing the glossing process on a print medium.

In the present embodiment, a print job which requires the printer engine 103 to execute both the printing process and the glossing process will be referred to as "a gloss print job". On the other hand, a print job which requires the printer engine 103 to execute only the printing process, but not the glossing process will be referred to as "a non-gloss print job".

Further, in the present embodiment, there is employed a method of performing not only an image forming operation using tones of four colors, i.e. cyan, magenta, yellow, and black but also an image forming operation using a clear toner. There two types in this method, and in the present embodiment, one of the two types will be referred to as the one-pass method, and the other as the two-pass method.

These methods will be described with reference to FIG. 5.

Figure 5:
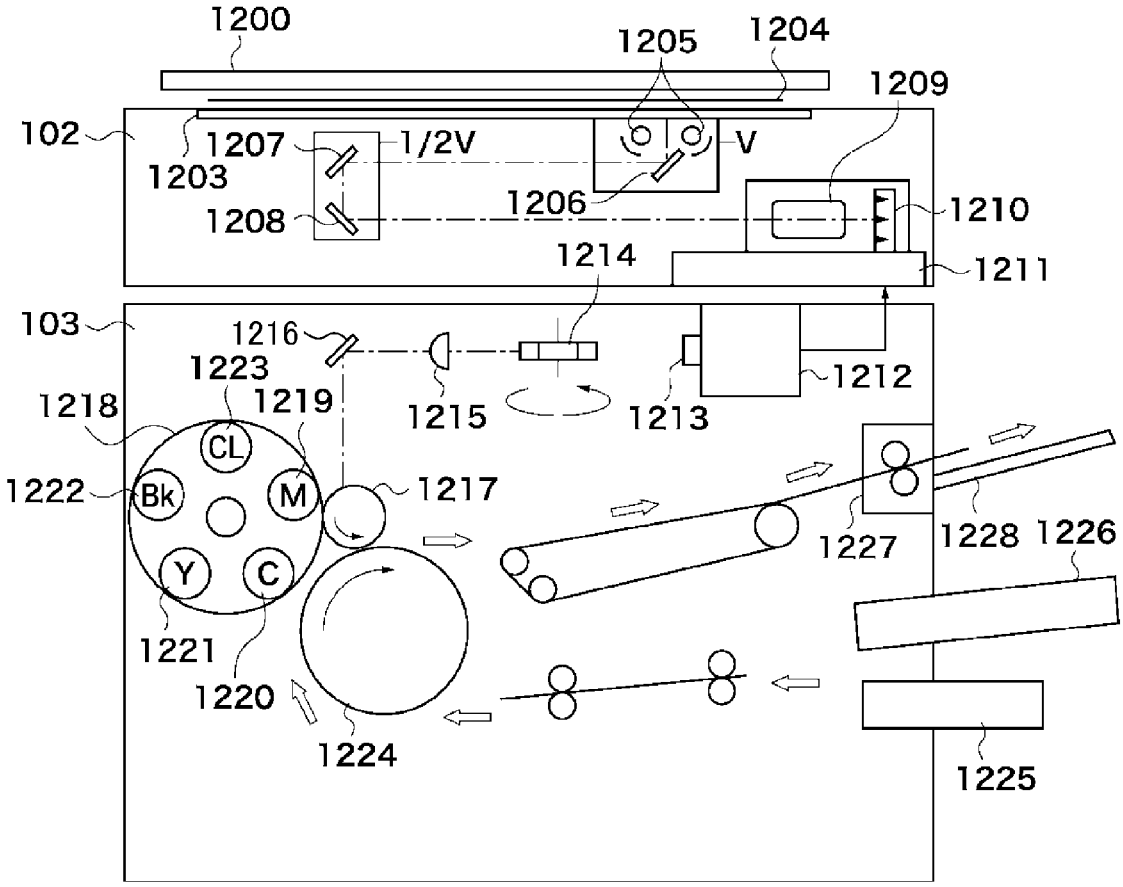
FIG. 5 is a cross-sectional view of the printing apparatus appearing in FIG. 1.

FIG. 5 is a cross-sectional view (mechanical diagram) of the printing apparatus 2000. The printing apparatus 2000 has an upper part thereof provided with a mechanism corresponding to the scanner engine 102 and a lower part thereof provided with a mechanism corresponding to the printer engine 103.

The scanner engine 102 includes a solid-state imaging device (hereinafter referred to as "the CCD"). The CCD optically reads an image printed on an original. As shown in FIG. 5, the scanner engine 102 is comprised of a mirror pressure plate 1200, an original platen glass 1203, a lamp 1205, mirrors 1206, 1207, and 1208, a lens 1209, the 3-line CCD 1210, and a data processor 1211 (corresponding to the image processor 107).

The lamp 1205 irradiates light onto an original 1204 on the original platen glass 1203. The mirrors 1206, 1207, and 1208 guide light reflected from the original 1204 to the lens 1209. The light from the mirror 1208 passes through the lens 1209 to form an image on the CCD 1210. The CCD 1210 photoelectrically converts the light and shade of the image formed on the CCD 1210 into electric charge amounts. Next, the electric charge amounts are sequentially read out and converted into an electric signal, which is delivered to the data processor 1211. The electric signal delivered from the CCD 1210 is an RGB signal having the components of three colors, i.e. red (R), green (G), and blue (B) obtained by decomposing the color. The lamp 1205 and the mirror 1206 mechanically move at a speed v in a direction perpendicular to the main scanning (electrical scanning) direction of the CCD 1210, and the mirror 1207 and the mirror 1208 move similarly at a speed of ½ v. Thus, the CCD 1210 carries out sub-scanning on the whole surface of the original 1204. The original 1204 is read at a resolution of 600 dpi (dots per inch) both in the main scanning direction and the sub scanning direction. The read image signal (RGB signal) data is stored in a memory of the data processor 1211 (corresponding to the image processor 107 in FIG. 2) in units of one page of the original.

The data processor 1211 processes the image signal (RGB signal) data stored in the memory on a pixel-by-pixel basis. Specifically, the data processor 1211 converts image data into color components of cyan (C), magenta (M), yellow (Y), and black (K) and then delivers the color components to the printer engine 103. Further, the data processor 1211 generates a clear (CL) color component on a pixel-by-pixel basis and outputs the generated CL color component to the printer engine 103. In short, the data processor 1211 delivers an image signal composed of the C, M, Y, K, and CL color components to the printer engine 103.

The printer engine 103 includes a laser driver 1212, a semiconductor laser 1213, a polygon mirror 1214, an f-θ lens 1215, a mirror 1216, a photosensitive drum 1217, and a rotary developing device 1218. Further, the printer engine 103 includes a transfer drum 1224, sheet cassettes 1225 and 1226, a fixing unit 1227, and a discharge tray 1228.

The laser driver 1212 receives the image signal composed of the C, M, Y, K, and CL color components and modulation-drives the semiconductor laser 1213 according to the received image signal.

A laser beam emitted by the semiconductor laser 1213 scans the surface of the photosensitive drum 1217 via the polygon mirror 1214, the f-θ lens 1215, and the mirror 1216. Thus, an electrostatic latent image is formed on the photosensitive drum 1217 at the same resolution of 600 dpi (dots per inch) both in the main and sub scanning directions as in the case of reading the original.

The rotary developing device 1218 is comprised of a magenta developing section 1219, a cyan developing section 1220, a yellow developing section 1221, a black developing section 1222, and a clear developing section 1223. The developing sections alternately come into contact with the photosensitive drum 1217 to develop the electrostatic latent image formed on the same.

The transfer drum 1224 has a sheet, which is fed from the sheet cassette 1225 or 1226, wound therearound and transfers the developed electrostatic latent image onto the sheet. In the one-pass method, toners of five colors, i.e. C, M, Y, K, and CL toners are sequentially transferred onto the sheet, and then fixed on the sheet by the fixing unit 1227. Then, the sheet is discharged onto the discharge tray 1228.

In the one-pass method, the glossing process is included in sequential processing from feeding of a sheet from the sheet feeder (1226 or 1225) to discharging of the same onto the discharge tray 1228. In other words, a single print process (print sequence) includes execution of the glossing process.

On the other hand, in the two-pass method, the glossing process is executed as follows:

Print sheets are set on the sheet feeder (1226 or 1225) and are fed into the printer engine 103 one by one. Then, the transfer and fixing of only C, M, Y, and K toners are first performed on each sheet by the developing sections (1219, 1220, 1221, and 1222) other than the CL developing section 1223, and the fixing unit 1227 (first fixing). Then, the print sheet having undergone the printing process is discharged onto the discharge tray 1228 (first discharging). As described above, only the printing process is completed first without carrying out the glossing process (i.e. without using clear toner) (which corresponds to the first printing process).

Thereafter, an operator takes out the print (preprint sheets) corresponding to the result of printing from the discharge tray 1228 and resets the same on the same sheet feeder (1226 or 1225) as used before. Then, the printed print sheets are guided into the printer engine 103 again, and only clear toner is fixed on the preprint sheets using the clear developing section 1223 and the fixing unit 1227 (second fixing). Thereafter, the print sheets having undergone the glossing process as well are discharged onto the discharge tray 1228 (second discharging). Thus, after the printing process, the glossing process is separately carried out (which corresponds to the second printing process).

As described above, only the printing process is first completed on print sheets, and then the glossing process is additionally or separately performed on the print sheets having undergone the printing process. In the present embodiment, this method in which the sequential processing is separated into two processes is defined as the two-pass method.

Thus, the gloss print job in the present embodiment is roughly divided into the first printing process (i.e. the process of printing a primary perceivable image from an original on a print sheet) and the second printing process (i.e. the process of carrying out the glossing process on the printed print sheet), and these first and second printing processes are sequentially executed by the printing apparatus 2000 (including the printer engine 103). Further, the printing apparatus 2000 is configured to be capable of discriminating between the two kinds of printing processes in handling them. Furthermore, the printing apparatus 2000 is configured to be capable of managing the two processes as one print job including the processes related to each other, using the controller 112.

Further, in the present embodiment, the controller 112 receives a user request for execution of the gloss print job via a user interface. For example, the user request is received via the UI panel 101 as a local user interface or via the display device 302 (and the keyboard 304) of the client PC 1000 as a remote user interface.

Upon reception of this request, the controller 112 performs control such that the first printing process of the first and second printing processes required for the gloss print job is executed first by the printing apparatus 2000 (including the printer engine 103). Then, after the first printing process is completed prior to the second printing process, the controller 112 performs control such that the second printing process required for the gloss print job is executed by the printing apparatus 2000 (including the printer engine 103). Further, the present embodiment is configured such that the user can select whether or not to carry out the glossing process, via one of the above-mentioned user interfaces. If an instruction for executing the glossing process for a print job to be processed is input, the controller 112 controls the printing apparatus 2000 to handle the print job as a gloss print job. On the other hand, if an instruction for executing the glossing process for the print job to be processed is not input, the controller 112 controls the printing apparatus 2000 to handle the print job as a non-gloss print job. As described above, when a non-gloss print job is received, the controller 112 controls the printing apparatus 2000 not to perform the glossing process. In this case, when a print sheet or print sheets having undergone printing process is/are discharged onto the discharge tray 1228, it is determined that the job is completed. Then, if another print job exists, control is performed such that processing for this print job is immediately started.

As described above, the printing apparatus 2000 according to the present embodiment is configured to be capable of performing the glossing process on each print medium subjected to printing process by the printer engine 103, using the same printer engine 103.

Further, in the present embodiment, when a gloss print job is received, control is performed by the controller 112 such that the process of carrying out the printing process (corresponding to the first printing process) and the process of carrying out the glossing process (corresponding to the second printing process) are sequentially executed using the printer engine 103. On the other hand, when a non-gloss print job is received, control is performed by the controller 112 such that the process of carrying out the printing process (corresponding to the first printing process) is executed using the printer engine 103, but the process of carrying out the glossing process (corresponding to the second printing process) is not.

Further, the present embodiment is configured such that the controller 112 selectively executes one of job recovery/cancellation control processes in a manner discriminating between them, i.e. according to which of the gloss print job and the non-gloss print job the print job is. In the following, a description will be given of this point.

In the present embodiment, each of the above-mentioned user interfaces is configured to be capable of enabling the user to select whether the glossing process should be executed as a one-pass gloss print job or a two-pass gloss print job.

First, the outline of the job recovery/cancellation control executed by the image forming apparatus according to the present embodiment in a manner compatible with a gloss print job will be described with reference to FIG. 6.

Figure 6:
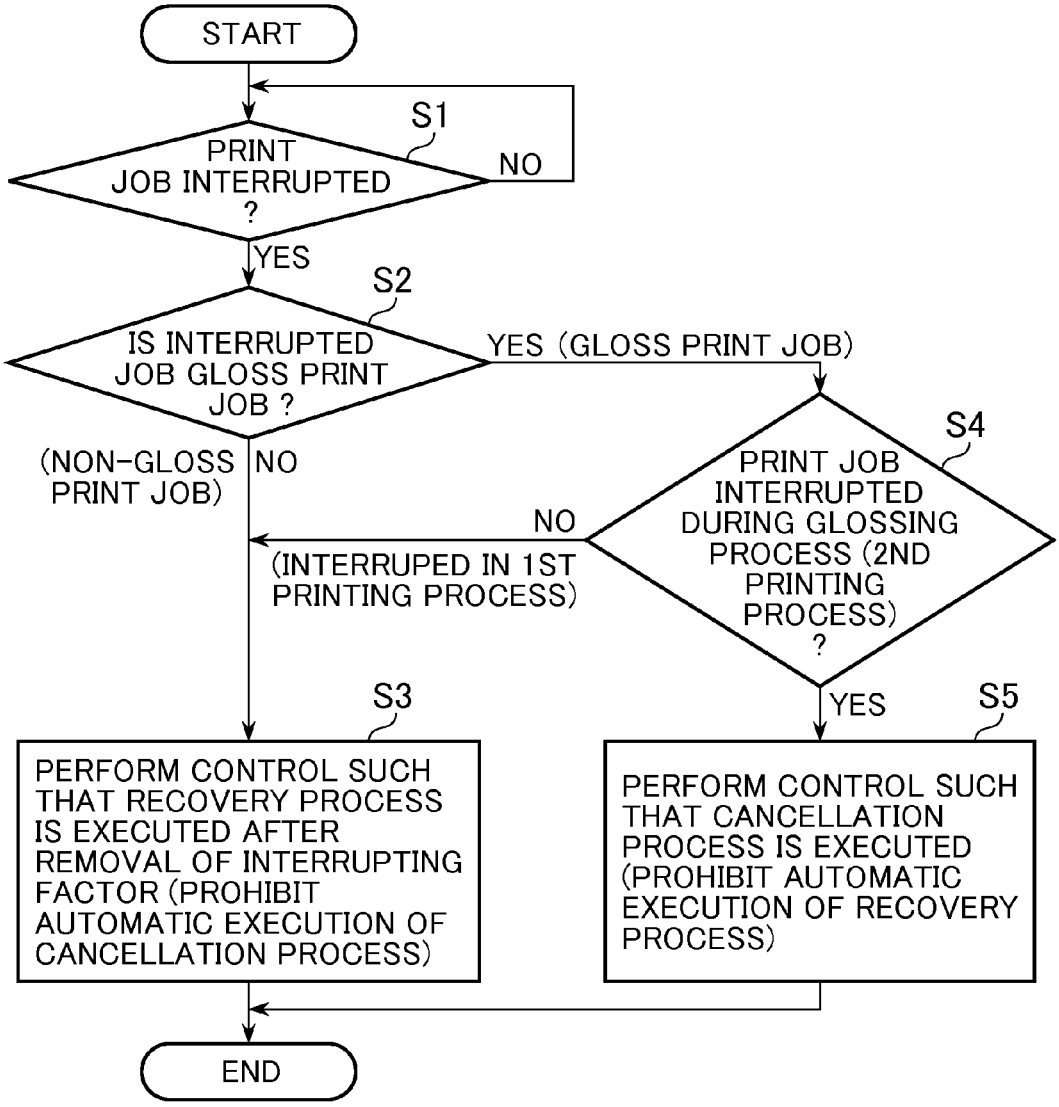
FIG. 6 is a flowchart of the outline of a job recovery/cancellation control process executed by the printing apparatus including the control apparatus according to the embodiment.

The job recovery/cancellation control process shown in FIG. 6 is executed when the printing apparatus 2000 (including the printer engine 103) develops an interrupting factor that interrupts a print job during execution of the print job.

In the present embodiment, in response to the occurrence of the interrupting factor in the printing apparatus 2000, the controller 111 of the printing apparatus 2000 performs control such that the execution of the print job is interrupted. Further, a computer-executable control program for executing the sequential processing (job recovery/cancellation control process) in FIG. 6 is stored in a predetermined memory of the printing apparatus 2000, and is read out for execution by the CPU of the controller 112.

First, the controller 112 determines in a step S1 whether or not execution of a print job has been interrupted in the printing apparatus 2000 due to occurrence of an interrupting factor concerning the print job in progress. If the answer to the question is affirmative (YES), the program proceeds to a step S2. What kinds of interrupting factors are applied here will be described at the end of the description of the present embodiment.

Next, the controller 112 determines in the step S2 whether or not the interrupted print job is a gloss print job.

If the interrupted print job is a non-gloss print job, the program proceeds to a step S3. For example, if the interrupted print job is one for which the user has not designated the glossing process via the user interface (i.e. a non-gloss print job), the program proceeds from the step S2 to the step S3.

When the program proceeds to the step S3, the controller 112 performs control such that a recovery process for the interrupted print job is executed by the printing apparatus 2000 after removal of the interrupting factor. The step S3 is applied as a step for performing such control as to prevent automatic cancellation of the interrupted print job.

In the present embodiment, the control in the step S3 is performed such that that the recovery process for the interrupted print job (the non-gloss print job in the present example) is automatically executed by the printing apparatus 2000 on condition that the interrupting factor that interrupts the print job is removed. Instead of the automatic execution of the recovery process on condition of removable of the interrupting factor, the recovery process may be manually executed by the operator.

For example, the controller 112 may perform control such that after removal of the interrupting factor, a screen is displayed on the user interface (e.g. the UI panel 101) for inquiring of the user whether to carry out the recovery process for the print job (which is determined as the non-gloss print job in the step S2 (NO to S2)). Then, the controller 112 may cause the printing apparatus 2000 to execute the recovery process for the print job after the operator inputs an instruction for executing the recovery process via the screen.

Next, a description will be given of a case where the answer to the question of the step S2 is affirmative (YES).

Let it be assumed that the controller 112 determines in the step S2 that the interrupted print job is a gloss print job. For example, if the interrupted print job is one for which the user has designated glossing process via the user interface (i.e. a gloss print job), the process proceeds from the step S2 to a step S4.

In the step S4, the controller 112 determines whether the interrupted print job (i.e. the gloss print job) has been interrupted during the first printing process or during the second printing process. More specifically, it is determined as to the gloss print job requiring both the printing process and the glossing process whether it has been interrupted during execution of the printing process or during execution of the glossing process.

The processing in the step S4 applies to a two-pass gloss print job. This point will be described in detail.

As mentioned hereinabove, in the two-pass gloss print job, the printing process (corresponding to the first printing process) is completed prior to execution of the glossing process (corresponding to the second printing process). These two kinds of processes are sequentially carried out independently at a time interval.

For example, in the two-pass gloss print job, the printer engine 103 performs the printing process (first printing process) on print media required for the job, and then all the print media for the print job are temporarily discharged onto the discharge tray 1228 attached to the outside of the printing apparatus 2000. Thereafter, the printed print media are set again in the sheet feeder (1225 or 1226) by the operator's manual operation. Then, the printed print media are guided into the printing apparatus 2000 and are subjected to the glossing process by the printer engine 103, followed by being discharged onto the discharge tray 1228 again. Thus, a final printed product having undergone the glossing process is obtained.

As described above, the processing of the two-pass gloss print job requires an operator's manual operation e.g. for setting print media again. In the present embodiment, the controller 112 performs control such that the two-pass gloss print job is processed by the printing apparatus 2000 in a specific sequence including a specific manual operation by an operator. Thus, the two-pass gloss print job is processed in the sequence different from those of the other kinds of print job (i.e. the non-gloss print job and the one-pass gloss print job).

For this reason, in the present embodiment, the job recovery/cancellation control for the two-pass gloss print job is performed based on an attribute (property/characteristic) of the two-pass gloss print job different from those of the other kinds of print jobs (i.e. the non-gloss print job sequence and the one-pass gloss print job sequence).

To this end, if the processing of the gloss print job has been interrupted, it is determined in the step S4 whether the processing has been interrupted during the first printing process (i.e. during execution of the printing process) or during the second printing process (i.e. during execution of the glossing process).

If it is determined in the step S4 that the processing has been interrupted during the first printing process, the program proceeds from the step S4 to the step S3. For example, if the present print job is a two-pass gloss print job in which the processing has been interrupted during the printing process, the process proceeds from the step S4 to the step S3. And, in the step S3, the controller 112 controls the printing apparatus 2000 such that the recovery process can be executed after removal of the interrupting factor.

On the other hand, if it is determined in the step S4 that the processing has been interrupted during the second printing process (i.e. during execution of the glossing process), the program proceeds from the step S4 to a step S5. For example, if the present print job is a two-pass gloss print job in which the processing has been interrupted during the glossing process, the program proceeds from the step S4 to the step S5.

In the step S5, the controller 112 controls the printing apparatus 2000 such that the cancellation process is executed for cancelling the interrupted print job. In other words, the controller 112 performs control such that recovery process is not automatically executed for the print job after removal of the interrupting factor (i.e. such that the recovery process is inhibited).

The recovery process (also referred to as the job recovery process) is defined in the present embodiment such that it can include re-executing a process step which is already in progress and interrupted at the time of occurrence of an interrupting factor, after removal of the interrupting factor.

For example, even when an interrupting factor occurs, print data for a print job to be processed in the step S3 is kept stored as it is in the HDD 111. Therefore, in the recovery process for this print job, the controller 112 causes the printer engine 103 to execute printing of the print job again using the print data stored in the HDD 111.

Further, the recovery process is defined such that it can also include execution of processing which is yet to be executed at the time of occurrence of an interrupting factor, after removal of the interrupting factor.

For example, when a sheet feeder is replenished with print media for a print job having its printing process interrupted due to running out of sheets, the recovery process is carried out so as to print the remaining pages left unprinted.

The cancellation process (also referred to as the job cancellation process) is defined in the present embodiment such that it can include making the printer engine 103 available for a different job from the interrupted print job.

For example, after an interrupting factor that has caused interruption of the interrupted print job is removed, the processing of the print job is not resumed, but the printing process for a print job awaiting processing with its print data stored in the HDD 111 (i.e. a succeeding print job) is started. The controller 112 thus causes the printer engine 103 not to execute the interrupted print job, but to preferentially execute the different print job. This is an example of the cancellation process.

As described above, if the interrupted print job is a two-pass gloss print job in which the processing is interrupted during the glossing process, the controller 112 causes the printer engine 103 to execute another print job in preference to the interrupted print job, after removal of an interrupting factor that has caused interruption of the interrupted print job. Thus, the controller 112 in the present embodiment controls scheduling between an interrupted print job and another print job and the like as well.

Concerning this point, let it be assumed that the interrupted print job is a non-gloss print job (or a two-pass gloss print job having its printing process interrupted). In short, let it be assumed that the program proceeds to the step S3. In this case, the controller 112 causes the printer engine 103 to execute the interrupted print job in preference to the other print jobs, after removal of an interrupting factor that has caused the interruption of the interrupted print job.

The cancellation process is defined such that it can also include processing for deleting print data for the interrupted print job from the HDD 111.

Further, the cancellation process is defined in the present embodiment such that it can include processing for deleting information on an interrupted print job from a list displaying information on the print job in progress and print jobs awaiting processing.

Although various forms of recovery process and cancellation process are described above by way of example, these are not limitative, though it is preferable that at least one of them is applied.

Similarly, various forms of the recovery process and the cancellation process are also applicable to the one-pass gloss print job.

For example, let it be assumed that the print job determined to be a gloss print job in the step S2 in FIG. 6 is a one-pass gloss print job. A one-pass gloss print job requires the glossing process, but the printing process and the glossing process are both performed by a one-time fixing (i.e. the sequential processing on each print medium is completed by passing the print medium from one of the sheet feeders to the discharge section once). Further, an operator's manual operation is not required during the sequential operation for obtaining a final printed product subjected to the glossing process. Therefore, the one-pass gloss print job also has an attribute similar to that of the non-gloss print job.

In view of this point, even when the interrupted print job is a gloss print job, if it is a one-pass gloss print job, the program proceeds to the step S3. Then, the controller 112 causes the recovery process to be performed (automatically or manually) by the printing apparatus 2000 for the one-pass gloss print job after removal of the interrupting factor. By incorporating such processing into the present control process, it is possible to meet the needs of handling a one-pass gloss print job in the same manner as handling a non-gloss print job.

Next, other configurations for processing the two-pass gloss print job will be described with reference to FIGS. 7A to 13B. Each of the configurations described with reference to FIGS. 7A to 13B is shown as a subordinate configuration, i.e. an example of the configuration shown in FIG. 6. The job recovery control (job cancellation control) in the present embodiment can be achieved simply by the configuration shown in FIG. 6. The configurations shown in FIGS. 7A to 13B are provided in view of user merits, and hence it is not necessary to incorporate all the configurations into the control process. In other words, even if the control process does not include some of the configurations shown in FIGS. 7A to 13B, it can be considered that the control process is encompassed in the present invention insofar as it has a configuration corresponding to that of the job recovery/cancellation control process in FIG. 6.

The following description is given of the configurations of recovery control to be performed at the time of occurrence of a sheet jam during execution of the two-pass gloss print job. In each of the following examples, it is assumed that the recovery process is executed upon occurrence of an error in a processing step using clear toner (i.e. the glossing process) in the two-pass gloss print job. In the two-pass gloss print job, each print sheet is passed through the transfer and fixing sections twice for one job, and therefore an optimal recovery method changes depending on whether a sheet jam has occurred during a first pass through the sections or during a second pass through the same, and according to details of a print job in the first pass. The recovery process is executed so as to enable the printing to be performed again based on print data stored e.g. in the HDD device 111. The first pass corresponds to a step for executing the printing process in the two-pass gloss print job, and the second pass corresponds to a step for executing the glossing process in the two-pass gloss print job after executing the printing process thereof. Further, the first printing process described hereafter corresponds to the printing process in the two-pass gloss print job, and the second printing process corresponds to the glossing process in the two-pass gloss print job.

FIGS. 7A and 7B are table diagrams showing classification of combinations of PDL print data for the first printing process and PDL print data for the second printing process and categories of the recovery/job cancellation control process executed upon occurrence of a trouble, such as a sheet jam, in the second printing process. In the present example, the recovery/job cancellation control process is classified into six categories (Categories I to IV) according to types of input print jobs. That is, the optimal recovery method changes according to an input print job.

(a) Category I

Category I corresponds to a case where for one print job, both the first and second printing processes each print one image on all (one) page, and the number of copies is one.

In this print job, the printout by the first printing process is only one page, and hence if a sheet jam occurs in the second printing process, the print job is resumed from the beginning. Therefore, the print job in progress is forcibly cancelled and terminated.

The cancellation process here is executed so as to make the printer engine 103 available for a different job from the interrupted print job. Further, the cancellation process includes deleting print data for the interrupted print job e.g. from the HDD 111, and deleting information on the interrupted print job from a list displaying information on print jobs yet to be processed.

(b) Category II

Category II corresponds to a case where for one print job, both the first and second printing processes each print one image on all (one) page, and the number of copies is more than one (m).

In this print job, the configuration of PDL print data is the same as that in Category I. However, since the number of copies is more than one, the print job is not simply cancelled, but the user is requested to determine whether to cancel the print job or continue the same after recovery, for the following one or more copies.

(c) Category III

Category III corresponds to a case where for one print job, PDL print data is provided for each of n pages for the first printing process, whereby the first printing process prints different images on the respective pages, whereas the second printing process prints the same image on all the pages, and the number of copies is one.

In this print job, the printout by the first printing process has a plurality of pages, and hence it is basically required to handle one copy (n sheets) as one set. When a sheet jam occurs, one set being processed at the time is wasted, and the first printing process has to be started again from the beginning. Therefore, the printing apparatus 2000 requests the user to determine whether to cancel the print job or continue the same after recovery.

(d) Category IV

Category IV corresponds to a case where for one print job, PDL print data is provided for each of n pages for the first printing process, whereby the first printing process prints different images on the respective pages, whereas the second printing process prints the same image on all the pages, and the number of copies is more than one (m).

In this print job, the printout by the first printing process has a plurality of pages, and hence it is basically required to handle one copy (n sheets) as one set, similarly to Category III. When a sheet jam occurs, one set being processed at the time is wasted, and the first printing process has to be resumed from the beginning. Therefore, the printing apparatus 2000 requests the user to determine whether to cancel the print job or continue the same after recovery.

The user designates cancellation of the print job or continuation of the same. If continuation of the print job is selected, since the printing of a plurality of copies is specified in Category IV, the user designates a resuming position for a resuming condition and performs adjustment of preprint sheets on the sheet feeder. The adjustment of preprint sheets on the sheet feeder (setting the first page of a copy at the top) is required when the resuming position is set to "first page of next copy" is designated as.

(e) Category V

Category V corresponds to a case where for one print job, PDL print data is provided for each of n pages for the first printing process, whereby the first printing process prints different originals on the respective pages, and for the second printing process as well, PDL print data is provided for each of the preprinted pages, whereby the second printing process prints different images (patterns) on the respective preprinted pages, and the number of copies is one.

Category V is basically identical to Category IV. However, since the print data for the second printing process has n pages, in designating a resuming position, it is required to adjust a start position of the PDL print data for the second printing process to "next page".

(f) Category VI

Category VI corresponds to a case where for one print job, PDL print data is provided for each of n pages for the first printing process, whereby the first printing process prints different images on the respective pages, and for the second printing process as well, PDL print data is provided for each of the preprinted pages, whereby the second printing process prints different images (patterns) on the respective preprinted pages, and the number of copies is more than one (m).

Category VI is basically identical to Category IV. However, since PDL print data for the second printing process has n pages, when a resuming position is designated, it is required to adjust a start position of the PDL print data for the second printing process to "next page" or "first page".

Figure 8:
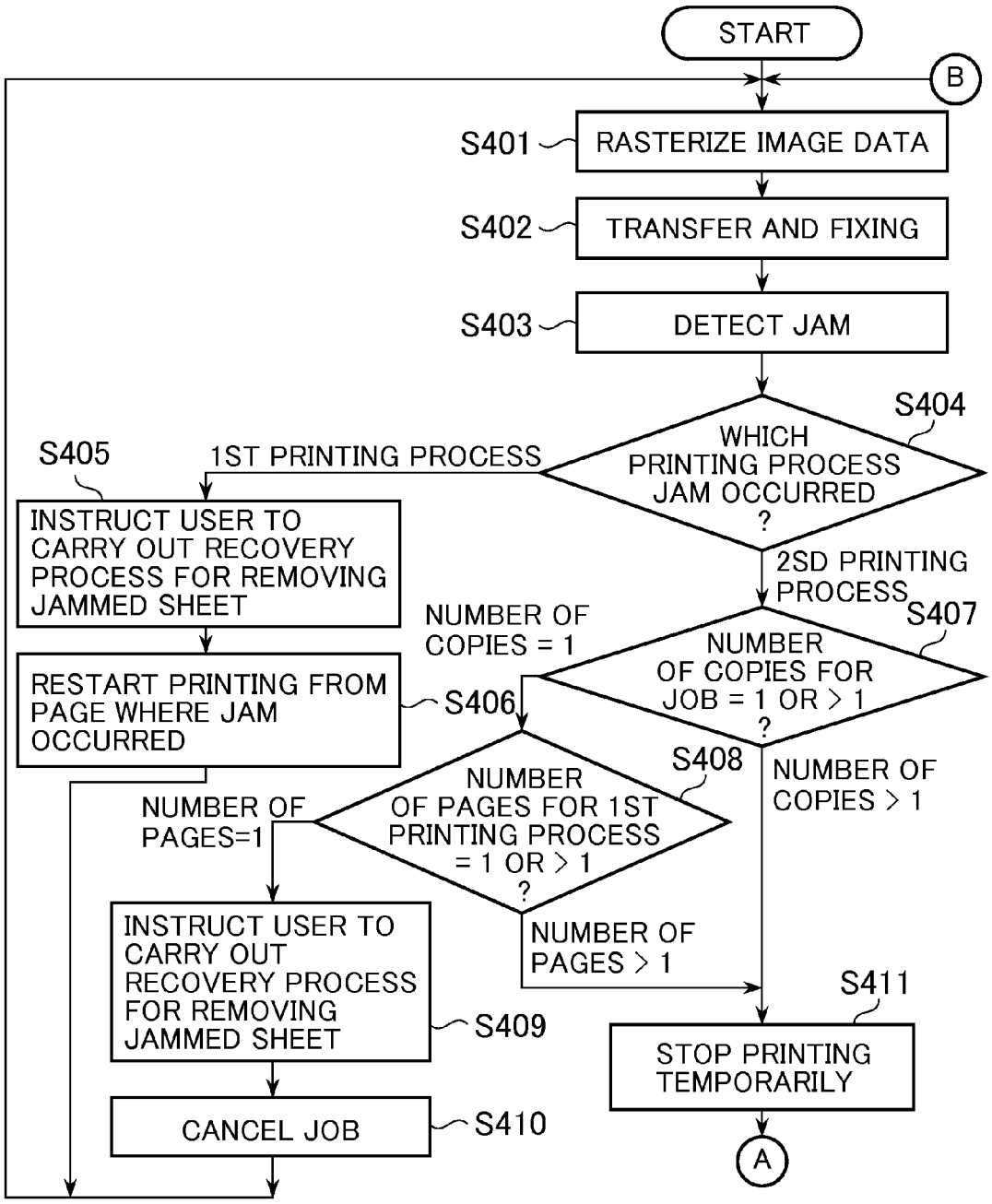
FIG. 8 is a flowchart of a job recovery/cancellation control process executed when a sheet jam has occurred.
Figure 9A:
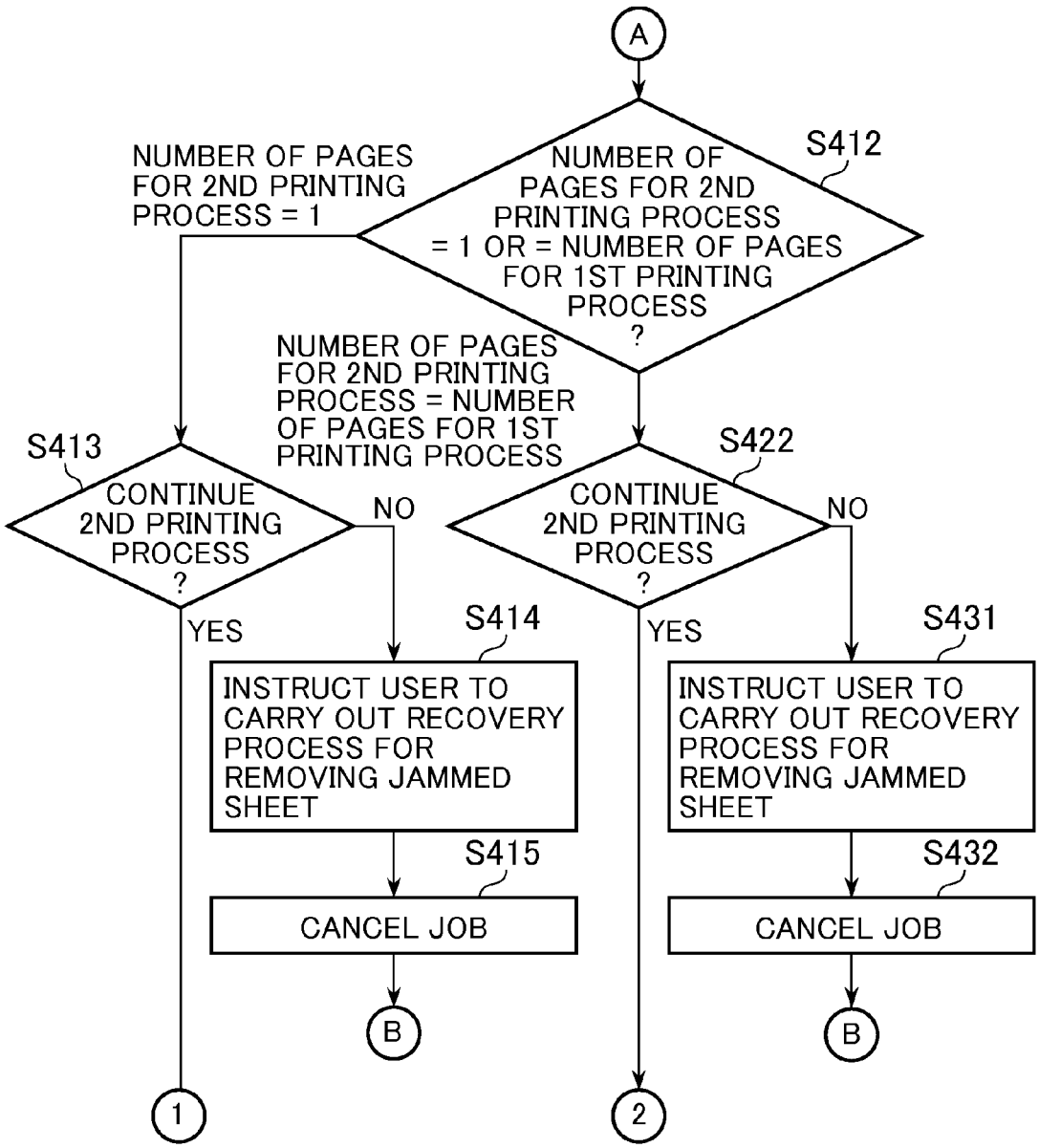
FIGS. 9A and 9B are continuations of the flowchart in FIG. 8.
Figure 9B:
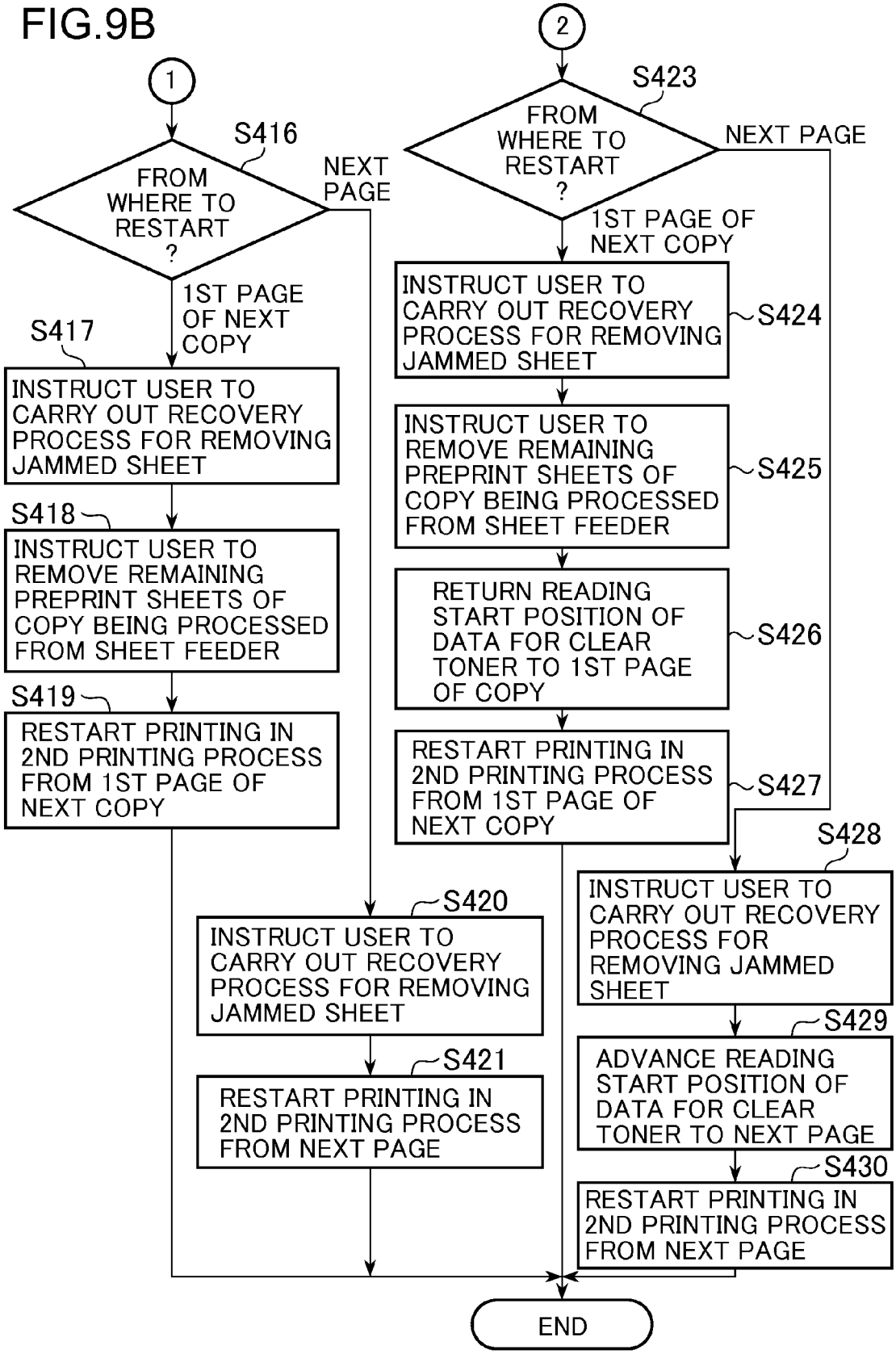

FIGS. 8 to 9B are a flowchart of the recovery/job cancellation control process executed at the time of occurrence of a sheet jam.

The job management section 109 of the printing apparatus 2000 executes the job recovery/cancellation control process to thereby determine the operation of the printing apparatus 2000 to be performed at the occurrence of a sheet jam. Determinations in the present recovery process are made based on four kinds of information, i.e. the number of PDL pages in the first printing process, the number of PDL pages in the second printing process, the number of copies, and a printing step where the sheet jam has occurred.

Based on these pieces of information, it is determined whether to forcibly cancel a print job, or to continue or cancel the print job after checking user's determination. In the present embodiment, in many cases, a print job is cancelled after checking user's determination. However, when PDL print data for the second printing process has a plurality of pages (Category V and Category VI in FIG. 7B), it can be envisaged that the print job is forcibly cancelled by the printing apparatus 2000. Hereafter, the six patterns (Categories I to VI) in FIGS. 7A and 7B will be described with reference to the flowchart in FIGS. 8, 9A and 9B.

PDL print data is input to the printing apparatus 2000 from the client PC 1000 via the network 3000. When reception of the PDL print data is started by the network controller 108, the job management section 109 of the printing apparatus 2000 starts the image processor 107 first, instructs the image processor 107 to rasterize the PDL print data into image data and the printer controller 106 to start printing of a rasterized page (S401).

When the rasterized page is delivered to the printer engine 103 via the printer controller 106, the printing process including transfer and fixing is started (S402). If some trouble, such as a sheet jam, occurs during the printing process, a detailed reason for interrupting the printing process is sent as event information to the job management section 109 via the printer controller 106 and the image processor 107 (S403). At this time point, the job management section 109 is aware of a printing step being currently performed for the print job, the number of pages of the PDL print data for each of the printing steps, and the number of copies to be printed by the print job. Therefore, based on these pieces of information, it is determined whether the error has occurred during the first printing process or during the second printing process (S404).

If it is determined that the error has occurred during the first printing process in which the printing process is performed on a blank sheet, the process proceeds to a step S405, wherein the user is prompted to remove the jammed sheet, and then after the removal of the jammed sheet, the process proceeds to a step S406, wherein the printing process is resumed from the page where the sheet jam occurred (S405 and S406). On the other hand, if it is determined that the error has occurred in the second printing process, the process proceeds to a step S407, wherein it is determined whether the number of copies to be printed by the print job is one or more than one. If the number of copies is one (corresponding to Category I, III, or V in FIGS. 7A and 7B), the process proceeds to a step S408, whereas if the number of copies is more than one (corresponding to Category II, IV, or VI in FIGS. 7A and 7B), the process proceeds to a step S411.

In the step S408, the number of pages of the PDL print data for the first printing process is checked. If the PDL print data has only one page, the process proceeds to the steps S409 and 410 to cancel the print job, whereas if the PDL print data has a plurality of pages, the process proceeds to the step S411 (corresponding to Category III, VI, V, or VI in FIGS. 7A and 7B). In the step S411, the printing process is temporarily stopped (S412), and then in a step S412, it is determined whether PDL print data for the second printing process has only one page or the same number of pages as the PDL print data for the first printing process, and if the PDL print data has only one page, the process proceeds to a step S413.

In the step S413, the user is requested to select whether or not to continue the processing in the second printing process. If the cancellation of the processing is selected, the process proceeds to a step S414, wherein the user is prompted to remove the jammed sheet, and then after the removal of the jammed sheet, the process proceeds to a step S415, the cancellation process is carried out. On the other hand, if the continuation of the processing is selected, the process proceeds to a step S416, wherein a resuming position after removal of the interrupting factor is determined. If the first page of the next copy is determined as the resuming position, the process proceeds to a step S417, wherein the user is prompted to remove the jammed sheet, and then after the removal of the jammed sheet, the process proceeds to a step S418, wherein the user is prompted to remove the remaining preprint sheets of the copy being processed to thereby cause the user to carry out resuming position-setting processing such that the uppermost one of preprint sheets on the sheet feeder is the first page of the next copy. Then, the processing of the second printing process (the glossing process) is resumed (S419). If the next page is determined as the resuming position in the step S416, the process proceeds to a step S420, wherein the user is caused to carry out only the processing for removing jammed sheet (S420), and then the processing of the second printing process (the glossing process) is resumed (S421).

If it is determined in the step S412 that the PDL print data for the second printing process has a plurality of pages, the process proceeds to a step S422, wherein the user is requested to determine whether or not to continue the second printing process. If the print job is to be cancelled, the process proceeds to a step S431 wherein the user is prompted to remove the jammed sheet, and then the process proceeds to a step S432, wherein the print job is cancelled. If the print job is to be continued, the process proceeds to a step S423, wherein the user is requested to determine a resuming position of printing. If the leading end of a copy is determined as the resuming position, steps S424 to S427 are executed, whereas if the next page is determined as the resuming position, steps S428 to S430 are executed. The processing in the steps S424 to S430 is different from that in the steps S417 to S421 in that since the PDL print data for the second printing process has a plurality of pages, it is required to perform not only the resuming position-setting processing for the preprint sheets printed by the first printing process such that the uppermost one of preprint sheets on the sheet feeder is the first page of the next copy, but also resuming position-setting processing for the PDL print data for the second printing such that a resuming position from which the reading of the PDL print data is resumed is set to the first page or the next page (S426 and S429).

Figure 10:
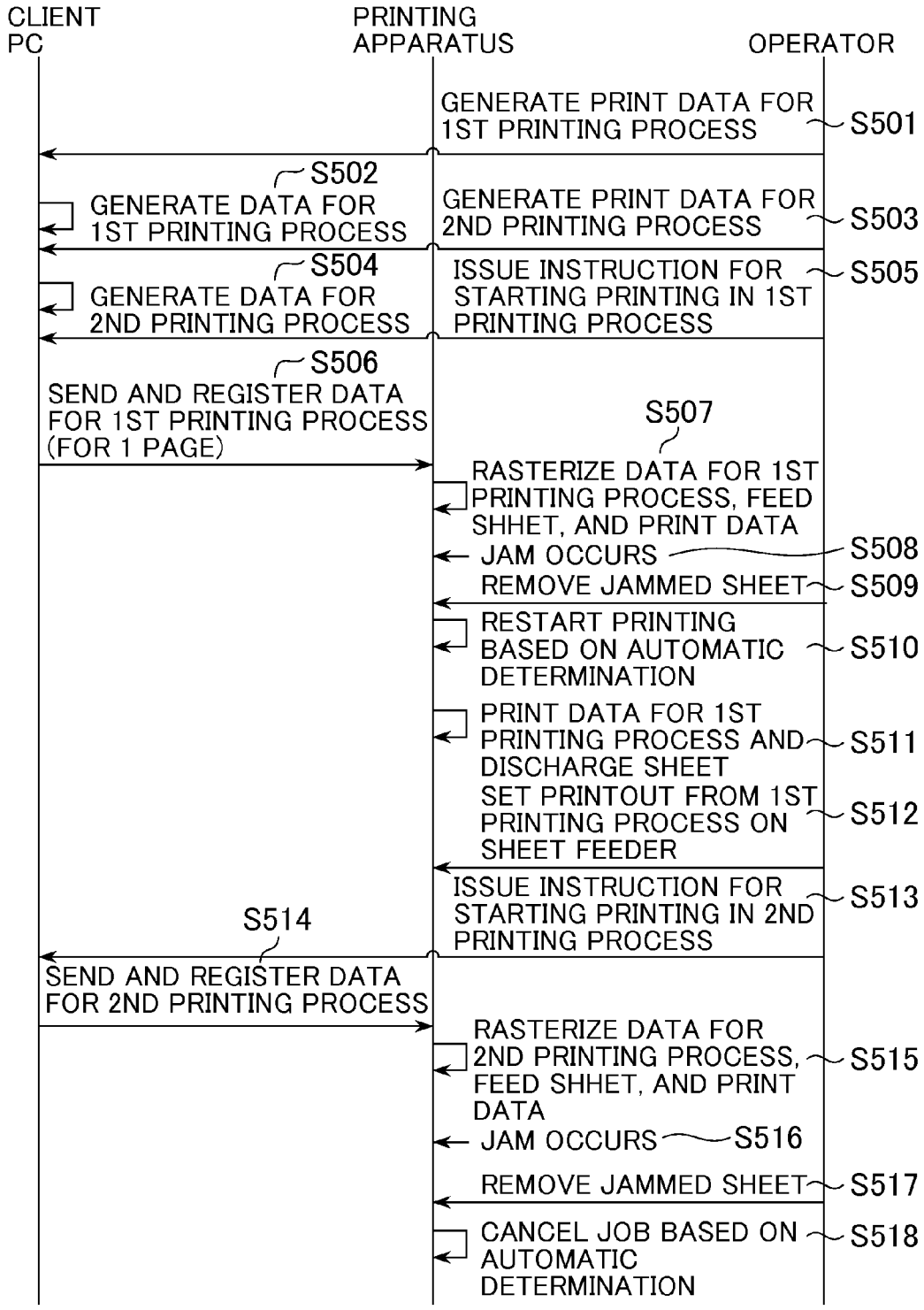
FIG. 10 is a sequence diagram of a first example of a recovery sequence executed by the printing apparatus including the control apparatus according to the embodiment.

FIG. 10 is a diagram of a recovery sequence executed when a print job of Category I in FIG. 7A is transferred to the printing apparatus 2000, and a sheet jam occurs during execution of the print job.

Based on information on the print job of Category I in FIG. 7A input to the printing apparatus 2000 from the client PC 1000, the job management section 109 determines and controls recovery conditions for the print job.

First, in steps S501 and S502, PDL print data for the first printing process is generated, and in steps S503 and S504, PDL print data for the second printing process is generated. In response to the operator's instruction for starting printing in the first printing process, the client PC 1000 sends data of a page for the first printing process to the printing apparatus 2000. Steps S507 to S512 correspond to the first printing process, and when a sheet jam occurs during execution thereof, the recovery process is executed in the steps S508 to S511. In the first printing process, printing is performed on a blank sheet, and hence after recovery from the sheet jam, printing can be immediately resumed.

After completion of the first printing process, the sheet delivered as a printed product (preprint sheet) in the step S511 is set again on the sheet feeder in the step S512 so as to execute the second printing process. After completion of the setting of the sheet, the operator instructs the client PC 1000, in a step S513, to send PDL print data so as to start the second printing process, whereby the PDL print data is sent from the client PC 1000 to the printing apparatus 2000 in a step S514.

In a step S515, the PDL print data is rasterized by the image processor 107, and the preprint sheet is fed from the sheet feeder to start printing. If a sheet jam occurs after the start of printing in the second printing process (S516), jammed sheet removal processing is carried out in a step S517, and then in a step S518, the cancellation process for cancelling the print job is executed (corresponding to S409 and S410). The internal processing of the printing apparatus 2000 is executed by the job management section 109.

Figure 11:
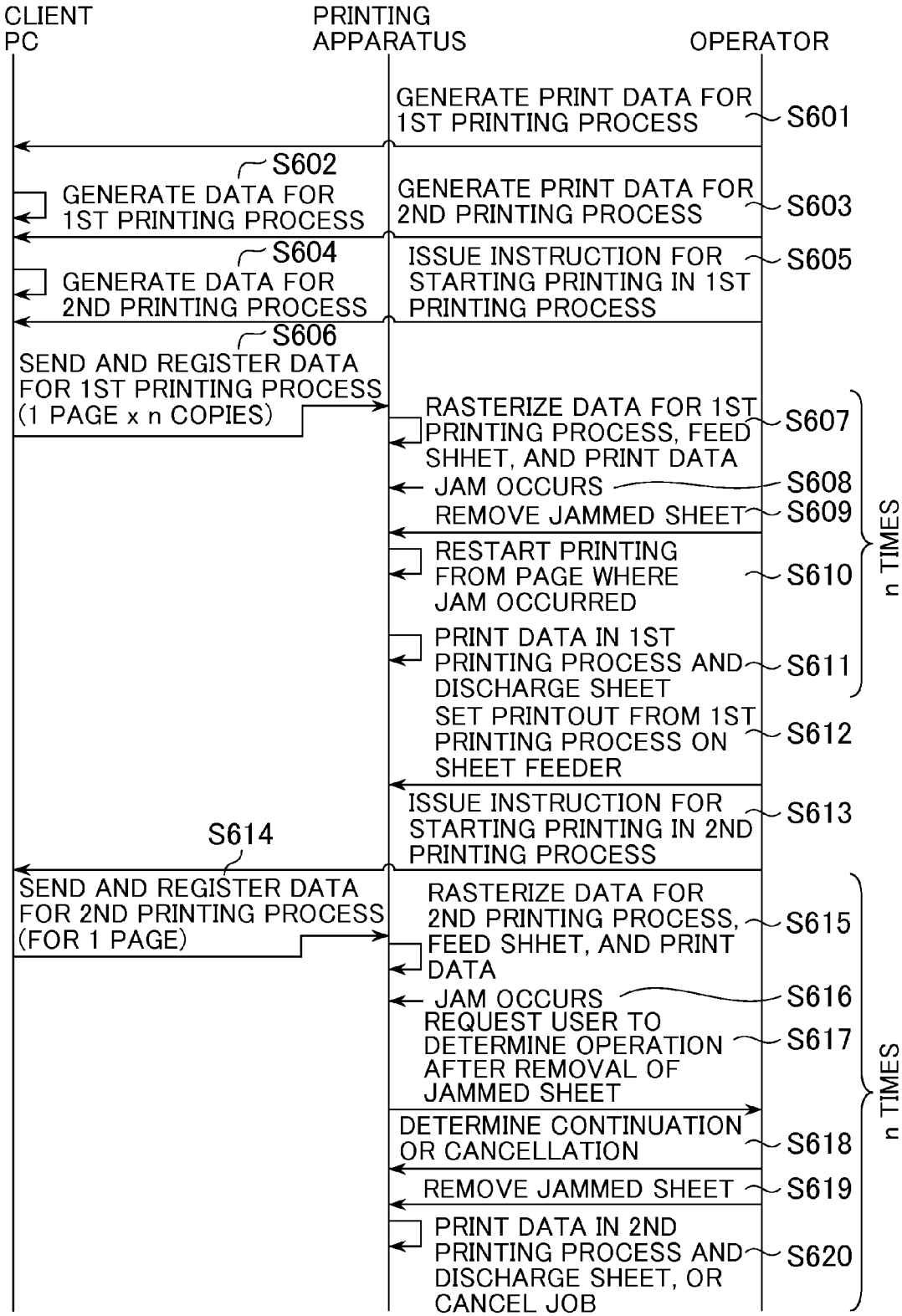
FIG. 11 is a diagram of a second example of the recovery sequence executed by the printing apparatus including the control apparatus according to the embodiment.

FIG. 11 is a diagram of a recovery sequence executed when a print job of Category II in FIG. 7A is transferred to the printing apparatus 2000, and a sheet jam occurs during execution of the print job.

Based on information on the print job of Category II in FIG. 7A input to the printing apparatus 2000 from the client PC 1000, the job management section 109 determines and controls recovery conditions for the print job.

Similarly to the steps S501 to S512 in FIG. 10, steps S601 to S612 correspond to the first printing process. The second printing process is started with a step S613 in which the operator instructs the client PC to send PDL print data, and in a step S615, sheet feeding and printing are started by the job management section 109 and the printer controller 106. When a sheet jam occurs in a step S616 after the start of printing, the user is requested in steps S617 to S618 to select an operation after recovery from the sheet jam, i.e. continuation of the print job or cancellation of the same, and then the recovery process is executed in a step S620 according to the user's instruction (corresponding to S413 to S421).

Figure 12:
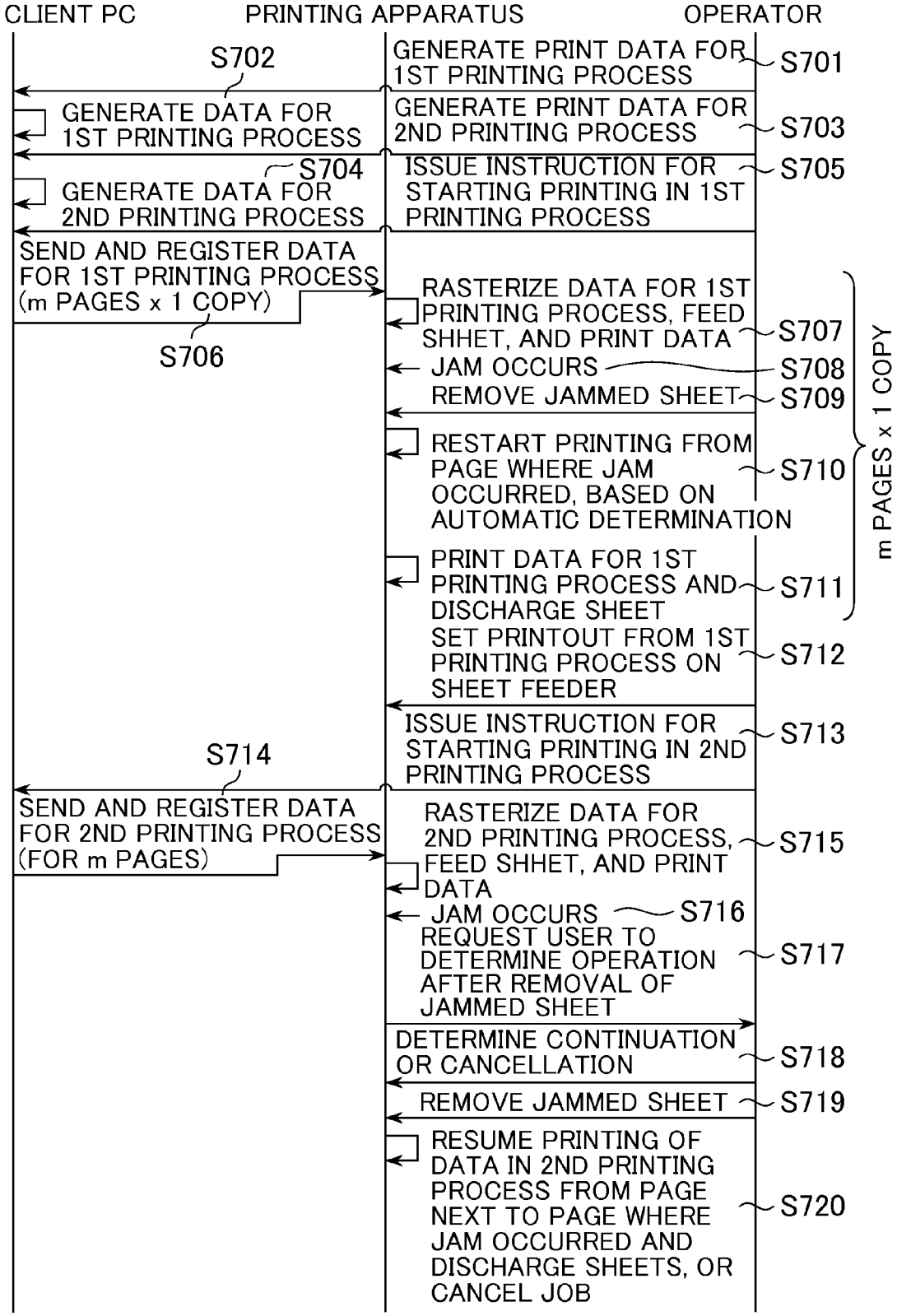
FIG. 12 is a diagram of a third example of the recovery sequence executed by the printing apparatus including the control apparatus according to the embodiment.

FIG. 12 is a diagram of a recovery sequence executed when a print job of Category III in FIG. 7A is transferred to the printing apparatus 2000, and a sheet jam occurs during execution of the print job.

Based on information on the print job of Category III in FIG. 7A input to the printing apparatus 2000 from the client PC 1000, the job management section 109 determines and controls recovery conditions for the print job.

Similarly to the steps S501 to S512 in FIG. 10, steps S701 to S712 correspond to the first printing process. The second printing process is started with a step S713 in which the operator instructs the client PC to send PDL print data, and in a step S715, sheet feeding and printing are started by the job management section 109 and the printer controller 106. When a sheet jam occurs in a step S716 after the start of printing, the user is requested in steps S717 to S718 to select an operation after recovery from the sheet jam, i.e. continuation of the print job or cancellation of the same, and then the recovery process is executed in a step S720, according to the user's instruction (corresponding to S412, S422, S423, S428 to S430, S431 to S432).

Figure 13A:
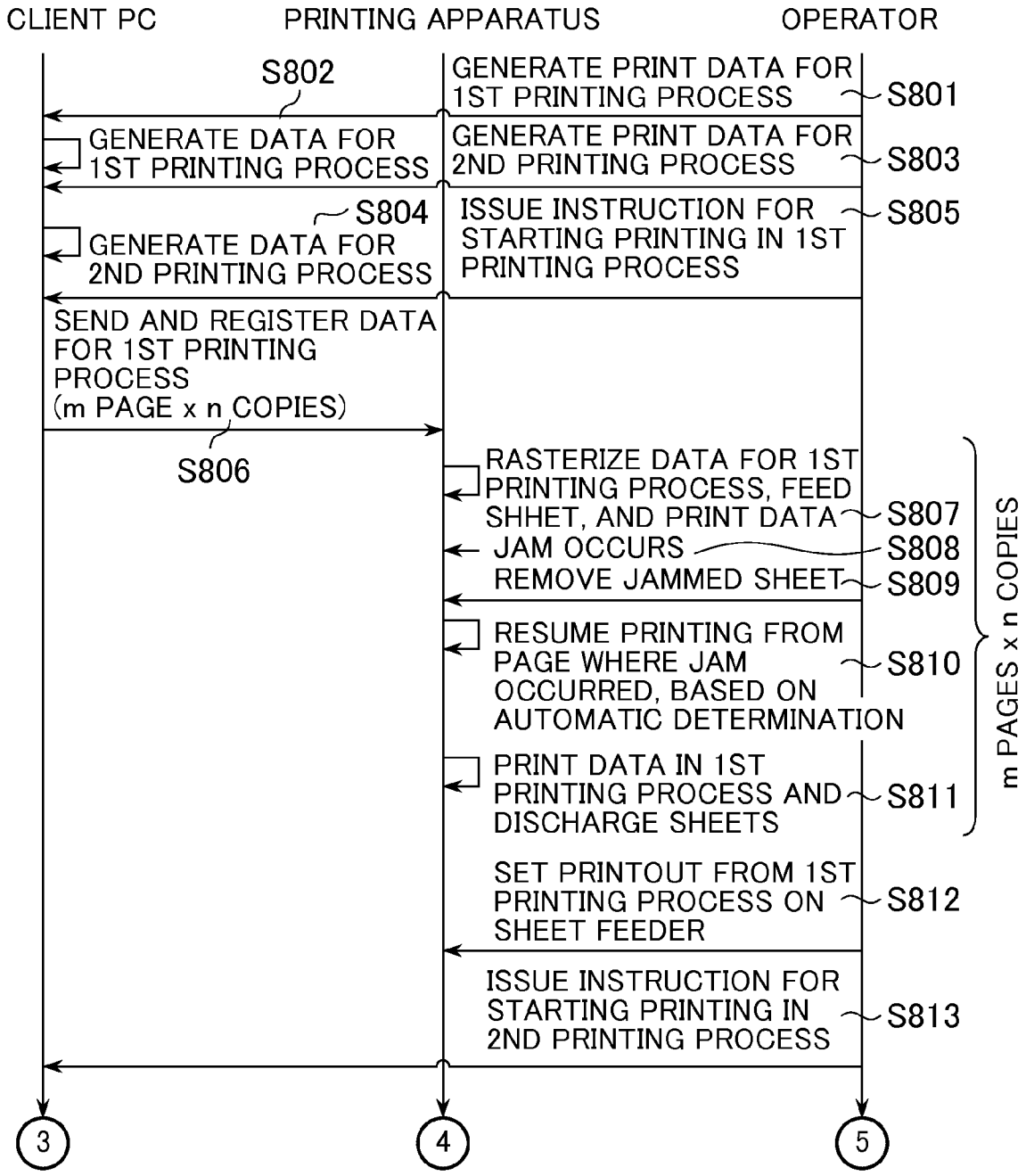
FIGS. 13A and 13B are diagrams of a fourth example of the recovery sequence executed by the printing apparatus including the control apparatus according to the embodiment.
Figure 13B:
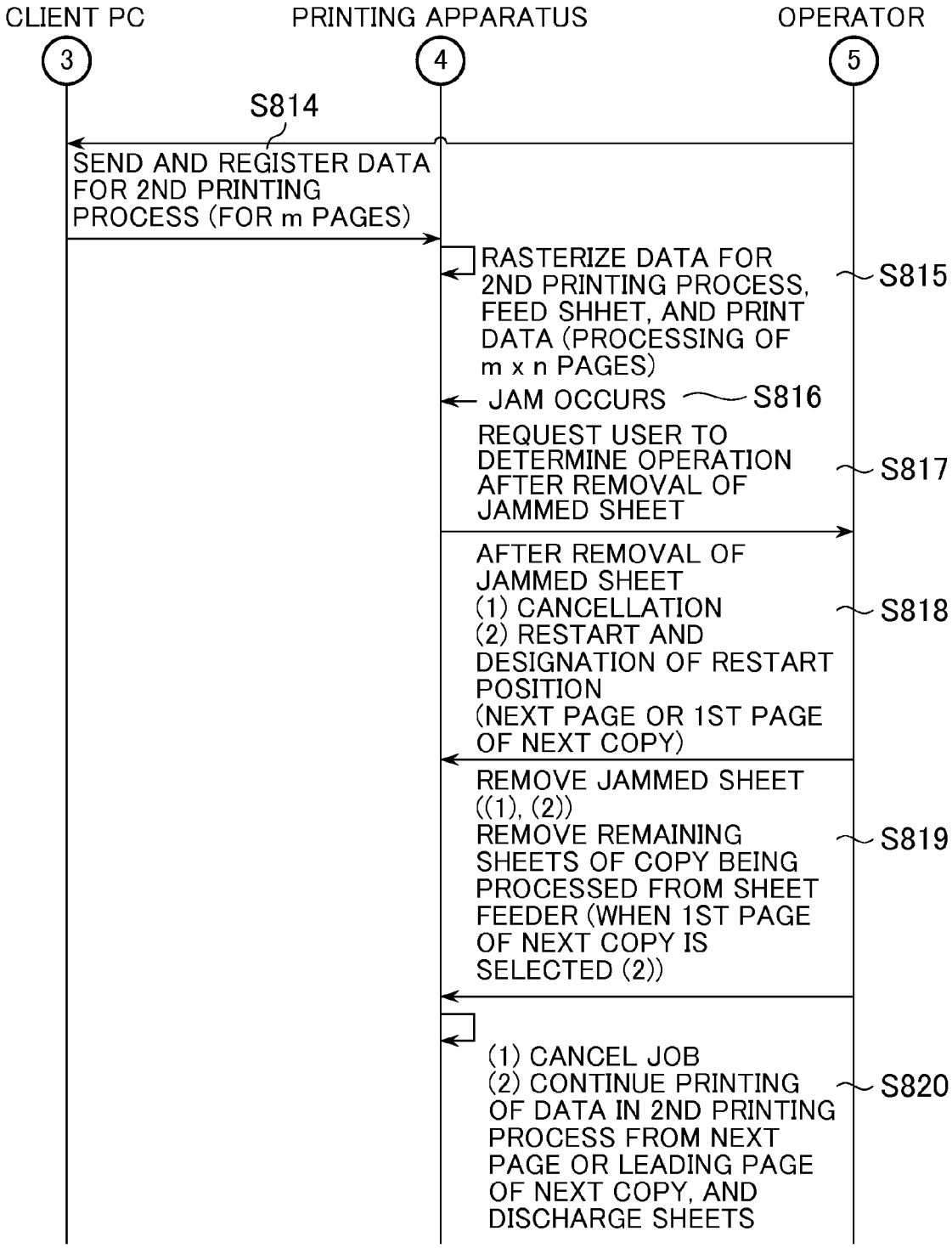

FIGS. 13A and 13B are diagrams of a recovery sequence executed when a print job of Category IV in FIG. 7B is transferred to the printing apparatus 2000, and a sheet jam occurs during execution of the print job.

Based on information on the print job of Category IV in FIG. 7B input to the printing apparatus 2000 from the client PC 1000, the job management section 109 determines and controls recovery conditions for the print job. The present sequence is different from the FIG. 12 sequence in that printing of a plurality copies is designated. Accordingly, the user selects the resuming position after the recovery between "next page" and "first page of next copy" (corresponding to S420 to S430).

In the following, a supplemental description will be given of points common to all the examples described above in the present embodiment.

(1) In the present embodiment, determination and control in the job recovery/cancellation control process described hereinabove are performed by the controller 112. The computer-executable control program for executing the job recovery/cancellation control process is stored in the predetermined memory within the printing apparatus 2000. The above-described various operations of the control process are carried out by reading out and executing the control program by the CPU of the controller 112. However, this is only exemplary, and it is possible to employ any other form insofar as the above described control operations can be realized.

(2) In the present embodiment, the controller 112 monitors whether or not an interrupting factor has occurred during execution of a print job by the printing apparatus 2000. When an interrupting factor that causes interruption of a print job occurs during execution of the print job, the controller 112 causes the printing apparatus 2000 to immediately suspend the print job, i.e. cause interruption thereof.

Although in the above description of the present embodiment, a sheet jam is taken as an example of the interrupting factor, it is only required that at least one of events listed below be applicable as an interrupting factor.

<Original Jam>

In a case where this interrupting factor has occurred, the controller 112 determines that the interrupting factor that interrupts a print job has been removed, when it is confirmed based on information from a sensor of the scanner engine 102 that the original jam has been removed by the operator.

<Scanner Error>

In a case where this interrupting factor has occurred, the controller 112 determines that the interrupting factor that interrupts a print job has been removed, when it is confirmed based on information from a sensor of the scanner engine 102 that the scanner error in the scanner engine 102 has been removed by the operator.

<Sheet Jam>

In a case where this interrupting factor has occurred, the controller 112 determines that the interrupting factor that interrupts a print job has been removed, when it is confirmed based on information from a sensor of the printer engine 103 that the sheet jam in the printer engine 103 has been removed by the operator.

<Paper-Out Error>

In a case where this interrupting factor has occurred, it is determined based on information from a sensor of a sheet feeder (225 or 226) where sheets has run out during execution of printing process by the printing apparatus 2000, whether or not the operator has replenished the sheet feeder with print sheets required for the interrupted print job. If it is confirmed that the sheet feeder has been replenished, the controller 112 determines that the interrupting factor that interrupts the print job has been removed.

<Memory-Full Error>

In a case where this interrupting factor has occurred, the controller 112 determines that the interrupting factor that interrupts a print job has been removed, when it is confirmed based on status information indicative of the remaining capacity of the HDD 111 that the memory-full error has been removed.

<Finisher Error>

The finisher error includes a staple-out error and a staple jam which occur in a finisher connected to the printing apparatus 2000. In a case where this interrupting factor has occurred, the controller 112 determines that the interrupting factor that interrupts a print job has been removed, when it is confirmed based on sensor information from the finisher connected to the printing apparatus 2000 that the cause of the finisher error has been removed.

As described above, the printing apparatus 2000 according to the present embodiment is configured to be applicable to various variations. However, the above-mentioned cases are only exemplary, and the scope of application of the printing apparatus 2000 is not limited to the cases.

(3) In the present embodiment, the one-pass gloss print job is handled as a print job having the same attribute as that of the non-gloss print job, as described with reference to FIG. 6 by way of example. However, the same control as executed for the two-pass gloss print job may be applied to the one-pass gloss print job. In this case, any configuration of the control is possible insofar as it is within a range consistent with the above-described job recovery/job cancellation control process. For example, if the answer to the question of the step S2 in FIG. 6 is affirmative (YES), the process immediately proceeds to the step S5 without executing the determination in the step S4. The control can be performed according to the job recovery/job cancellation control process in FIG. 6 except for this point. The configuration may be thus varied within a range consistent with the above-described control process. This makes it possible to apply the present embodiment to both the one-pass method and the two-pass method. As a consequence, the present embodiment can also be applied to a printing apparatus which is capable of performing only one-pass gloss printing process. Of course, the present embodiment can also be applied to a printing apparatus which is capable of performing only two-pass gloss printing process. As described above, it is possible to make various changes and modifications. However, it is desirable that the present embodiment is applied to a gloss print job, such as the above-described two-pass gloss print job, which requires operator's work e.g. for setting print media on a sheet feeder again between the printing process and glossing process.

(4) Although in the present embodiment, a print job to be subjected to the above-described various forms of the control process is input from an external apparatus which is capable of performing data communication with the printing apparatus 2000 by way of example, this is not limitative. For example, the control process may be executed for a print job (copy job) in which data required for the printing process is input from the scanner engine 102, or a print job (box job) for printing print data stored in the HDD 111.

As described above, in the present embodiment, the controller 112 determines whether a print job interrupted due to occurrence of an interrupting factor is a non-gloss print job which does not require the glossing process or a gloss print job which requires the glossing process. Then, if the interrupted print job is not a non-gloss print job, but a gloss print job, the controller 112 causes the printing apparatus 2000 to execute the cancellation process for cancelling the print job.

Further, if the print job interrupted due to occurrence of the interrupting factor is a gloss print job, the controller 112 causes the printing apparatus 2000 to execute the recovery process for the print job.

Even further, if the print job interrupted due to occurrence of the interrupting factor is a non-gloss print job, the controller 112 permits recovery process for the print job to be automatically executed after removal of the interrupting factor. On the other hand, if the interrupted print job is a gloss print job, the controller 112 prohibits the recovery process for the print job from being automatically executed after removal of the interrupting factor.

Further, if the print job interrupted due to occurrence of the interrupting factor is a non-gloss print job, the controller 112 causes the printer engine 103 to execute the print job in preference to the other print jobs after removal of the interrupting factor. On the other hand, if the print job to be suspended is a gloss print job, the printer engine 103 causes another print job to be executed in preference to the interrupted print job.

According to the present embodiment having the various configurations described above by way of example, it is possible to reduce a burden placed on an operator in the recovery process for recovering the printing apparatus 2000 from a trouble that occurs in a flow of business operations for generating printed products through a plurality of printing steps, and execute an appropriate recovery process. This enables the user to continue the output operation including the multiple printing steps, without much concern for details of printing conditions.

Further, according to the present embodiment, the job recovery/cancellation control is performed, as described above, by handling a gloss print job in a manner discriminating from a non-gloss print job, whereby it is made possible to prevent a trouble from occurring because the interrupted print job is a gloss print job, and what is more, process the print job appropriately and smoothly after removal of the interrupting factor. For example, it is possible to prevent a printout unintended by a user from being produced because a gloss print job has been recovered by the same recovery process as that for a non-gloss print job. It should be noted that this applies to a case described below.

It is assumed that a user executing a gloss print job happens to leave a printing apparatus during occurrence of an interrupting factor (e.g. a sheet-out error), and another user (e.g. a user having instructed execution of a print job awaiting printing) comes to the printing apparatus. The latter user finds the current print job interrupted and tries first to remove the interrupting factor (by supplying sheets in the case of the present example) with a view to causing his/her own print job to be executed in due course. Thinking of the interrupting factor as a mere ordinary sheet-out error, the user carries out an ordinary work for recovery from the printing-suspended state, i.e. sets unused blank sheets on the sheet feeder in the present example. In response to this work, the printing apparatus automatically starts the recovery process for the print job, using the unused blank sheets. At this time, since the interrupted job is a gloss print job, the printing apparatus determines that the glossing process should be performed for the recovery process, and performs the glossing process on the unused blank sheets supplied by the latter user. As a consequence, a printout formed by white print sheets having no images printed thereon, but only having undergone the glossing process is produced. This is an example of a trouble expected in the present embodiment. The configurations provided by the present embodiment make it possible to prevent occurrence of such a trouble.

It is to be understood that the present invention may also be accomplished by supplying a system or an apparatus with a storage medium in which a program code of software, which realizes the functions of the above described embodiment, is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, an optical disk, such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

As described above, the present invention is not limited to the above described embodiment, but can be modified in various manners based on the subject matter of the present invention, which should not be excluded from the scope of the present invention.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2008-103785 filed Apr. 11, 2008, which is hereby incorporated by reference herein in its entirety.

What is claimed is:

1. A control apparatus comprising:

a process control unit configured to control to execute a printing process for printing an image on a sheet fed from a sheet feed unit, and to control to execute a glossing process for feeding the sheet on which the image is printed in the printing process from a sheet feed unit and glossing the fed sheet;

a resuming unit configured to resume, in a case where the printing process executed by said process control unit is interrupted by an interrupting factor, and then the interrupting factor is removed, the interrupted printing process without receiving a user instruction via an operation unit, and to prompt, in a case where the printing process includes printing on a plurality of copies of sheets and the glossing process executed by said process control unit is interrupted by an interrupting factor during execution of the glossing process on sheets of each of the plurality of copies of sheets in the glossing process and then the interrupting factor is removed, a user to select whether to resume the interrupted glossing process from a copy next to a copy of which the glossing process on the sheets is interrupted or from an intermediate part of the copy of which the glossing process on the sheets is interrupted, and resume the interrupted glossing process in accordance with the selection of the user, which is received via the operation unit.

2. The control apparatus according to claim 1, wherein the glossing process includes addition of a recording agent onto the sheet on which the image is printed in the printing process based on print data, and wherein, in a case where the glossing process is interrupted by the interrupting factor during execution of the glossing process for adding the recording agent onto each of sheets included in a plurality of sheets printed in the printing process, based on each of a plurality of patterns of print data, and then the interrupting factor is removed, said resuming unit is configured to prompt a user to select whether to resume the interrupted glossing process from the copy next to the copy of which the glossing process on the sheets is interrupted or from the intermediate part of the copy of which the glossing process on the sheets is interrupted, and resume the interrupted glossing process in accordance with the selection of the user, which is received via the operation unit.

3. The control apparatus according to claim 1, wherein, in a case where the glossing process executed by said process control unit is interrupted by the interrupting factor, said process control unit is configured to perform control such that a job including the interrupted glossing process is executed in preference to another job after removal of the interrupting factor.

4. A control method for a control apparatus, comprising:

controlling to execute a printing process for printing an image on a sheet fed from a sheet feed unit, and controlling to execute a glossing process for feeding the sheet on which the image is printed in the printing process from a sheet feed unit and glossing the fed sheet;

resuming, in a case where the executed printing process is interrupted by an interrupting factor and then the interrupting factor is removed, the interrupted printing process without receiving a user instruction via an operation unit; and prompting, in a case where the printing process includes printing on a plurality of copies of sheets and the executed glossing process is interrupted by an interrupting factor during execution of the glossing process on sheets of each of the plurality of copies of sheets in the glossing process and then the interrupting factor is removed, a user to select, via the operation unit, whether to resume the interrupted glossing process from a copy next to a copy of which the glossing process on the sheets is interrupted or from an intermediate part of the copy of which the glossing process on the sheets is interrupted; and resuming the interrupted glossing process in accordance with the selection of the user, which is received via the operation unit.

5. The control method according to claim 4, wherein the glossing process includes addition of a recording agent onto the sheet on which the image is printed in the printing process based on print data, and wherein, in a case where the glossing process is interrupted by the interrupting factor during execution of the glossing process for adding the recording agent onto each of sheets included in a plurality of sheets printed in the printing process, based on each of a plurality of patterns of print data, and then the interrupting factor is removed, a user is prompted to select whether to resume the interrupted glossing process from the copy next to the copy of which the glossing process on the sheets is interrupted or from the intermediate part of the copy of which the glossing process on the sheets is interrupted, and the interrupted glossing process is resumed in accordance with the selection of the user, which is received via the operation unit.

6. The control method according to claim 4, wherein, in a case where the glossing process is interrupted by the interrupting factor, a job including the interrupted glossing process is executed in preference to another job after removal of the interrupting factor.

7. A non-transitory computer-readable storage medium storing a computer-executable program for controlling a control apparatus, the computer-executable program comprising:

a code to control to execute a printing process for printing an image on a sheet fed from a sheet feed unit, and controlling to execute a glossing process for feeding the sheet on which the image is printed in the printing process from a sheet feed unit and glossing the fed sheet;

a code to resume, in a case where the executed printing process is interrupted by an interrupting factor and then the interrupting factor is removed, the interrupted printing process without receiving a user instruction via an operation unit; and a code to prompt, in a case where the printing process includes printing on a plurality of copies of sheets and the executed glossing process is interrupted by an interrupting factor during execution of the glossing process on sheets of each of the plurality of copies of sheets in the glossing process and then the interrupting factor is removed, a user to select whether to resume the interrupted glossing process from a copy next to a copy of which the glossing process on the sheets is interrupted or from an intermediate part of the copy of which the glossing process on the sheets is interrupted; and a code to resume the interrupted glossing process in accordance with the selection of the user, which is received via the operation unit.

* * * * *